US006204778B1

(12) United States Patent
Bergan et al.

(10) Patent No.: US 6,204,778 B1
(45) Date of Patent: Mar. 20, 2001

(54) TRUCK TRAFFIC MONITORING AND WARNING SYSTEMS AND VEHICLE RAMP ADVISORY SYSTEM

(75) Inventors: Terry Bergan; Rod Klashinsky, both of Saskatoon (CA)

(73) Assignee: International Road Dynamics Inc., Saskatchewab (CA)

( * ) Notice: Subject to any disclaimer, the term of this patent is extended or adjusted under 35 U.S.C. 154(b) by 0 days.

(21) Appl. No.: 09/122,993

(22) Filed: Jul. 28, 1998

(30) Foreign Application Priority Data

May 15, 1998 (CA) ..... 2238127
Jun. 16, 1998 (CA) ..... 2240916

(51) Int. Cl.[7] ..... G08G 1/01
(52) U.S. Cl. ..... 340/936; 340/905; 340/907; 340/917; 340/933; 340/943; 701/117; 701/119
(58) Field of Search ..... 340/905, 936, 340/933, 937, 941, 942, 943, 917, 907; 701/117, 119

(56) References Cited

U.S. PATENT DOCUMENTS

| | | | | |
|---|---|---|---|---|
| 2,325,435 | * | 7/1943 | Sykora | 340/936 |
| 3,047,838 | | 7/1962 | Hendricks . | |
| 3,233,084 | | 2/1966 | Kendall et al. . | |
| 3,275,984 | | 9/1966 | Barker . | |
| 3,397,304 | | 8/1968 | Auer, Jr. . | |
| 3,544,958 | | 12/1970 | Carey et al. . | |
| 3,680,043 | | 7/1972 | Angeloni . | |
| 3,788,201 | | 1/1974 | Abell . | |
| 3,835,945 | | 9/1974 | Yanianaka et al. . | |
| 3,920,967 | | 11/1975 | Martin et al. . | |
| 3,927,389 | | 12/1975 | Neeloff . | |
| 3,983,531 | | 9/1976 | Corrigan | 340/936 |
| 4,049,069 | | 9/1977 | Tamamura et al. . | |
| 4,163,283 | | 7/1979 | Darby . | |
| 4,250,483 | | 2/1981 | Rubner . | |
| 4,251,797 | | 2/1981 | Bragas et al. . | |
| 4,284,971 | | 8/1981 | Lowry et al. . | |

(List continued on next page.)

*Primary Examiner*—Brent A. Swarthout
(74) *Attorney, Agent, or Firm*—Nixon & Vanderhye P.C.

(57) ABSTRACT

Traffic monitoring and warning systems and vehicle ramp advisory systems are provided herein. Such system includes a set of sensor arrays comprising a set of above-road electro-acoustic sensor arrays which is disposed above a traffic lane approaching a hazard for producing signals which are indicative of whether the vehicle is an automobile or a truck and, if it is a truck, to record the presence of such truck, and to provide signals which are indicative of the speed of such truck. A processor is provided which has a memory for storing site-specific data related both to the geometry of the hazard and to signals which have been received from the set of above-road electro-acoustic sensor arrays. A traffic signalling device is associated with the traffic lane and is disposed downstream of the set of above-road electro-acoustic sensor arrays, the traffic signalling device being controlled by the processor. The processor is responsive to the signals from the set of above-road electro-acoustic sensor arrays for computing an actual speed of the truck and for computing a computed maximum safe speed for such truck at the hazard. The computed maximum safe speed of the truck is derived from the site-specific dimensional data of the hazard and from at least the initial speed of the truck, the computed maximum safe speed of the truck being a maximum safe speed for that truck safely to negotiate the hazard. The processor compares the computed actual speed of the truck with the computed maximum safe speed for the truck. Then, the processor automatically operates the traffic signalling device if the computed actual speed of the truck exceeds the computed maximum safe speed for the truck. The processor also discontinues operating the traffic signalling device if the computed actual speed of the truck no longer exceeds the computed maximum safe speed for the truck.

22 Claims, 19 Drawing Sheets

U.S. PATENT DOCUMENTS

| | | | | |
|---|---|---|---|---|
| 4,560,016 | | 12/1985 | Ibanez et al. . | |
| 4,591,823 | | 5/1986 | Horvat | 340/905 |
| 4,727,371 | | 2/1988 | Wulkowicz | 340/917 |
| 4,750,129 | | 6/1988 | Hengstmengel et al. | 340/910 |
| 4,789,941 | | 12/1988 | Nunberg | 340/943 |
| 4,793,429 | | 12/1988 | Bratton et al. . | |
| 4,806,931 | | 2/1989 | Nelson | 340/907 |
| 4,908,616 | | 3/1990 | Walker | 340/929 |
| 5,008,666 | | 4/1991 | Gebert et al. | 340/936 |
| 5,060,206 | | 10/1991 | DeMetz, Sr. . | |
| 5,066,950 | * | 11/1991 | Schweitzer et al. | 340/936 |
| 5,109,224 | | 4/1992 | Lundberg | 340/901 |
| 5,146,219 | | 9/1992 | Zechnall | 340/995 |
| 5,231,393 | | 7/1993 | Strickland | 340/936 |
| 5,250,946 | | 10/1993 | Stanzcyk | 340/936 |
| 5,298,738 | * | 3/1994 | Gebert et al. | 340/936 |
| 5,315,295 | | 5/1994 | Fujii | 340/936 |
| 5,420,580 | * | 5/1995 | Rawls | 340/905 |
| 5,448,219 | * | 9/1995 | Yoshikawa et al. | 340/905 |
| 5,617,086 | | 4/1997 | Klashinsky et al. | 340/905 |
| 5,864,304 | * | 1/1999 | Gerszberg et al. | 340/905 |
| 5,892,461 | * | 4/1999 | Dokko | 340/905 |

* cited by examiner

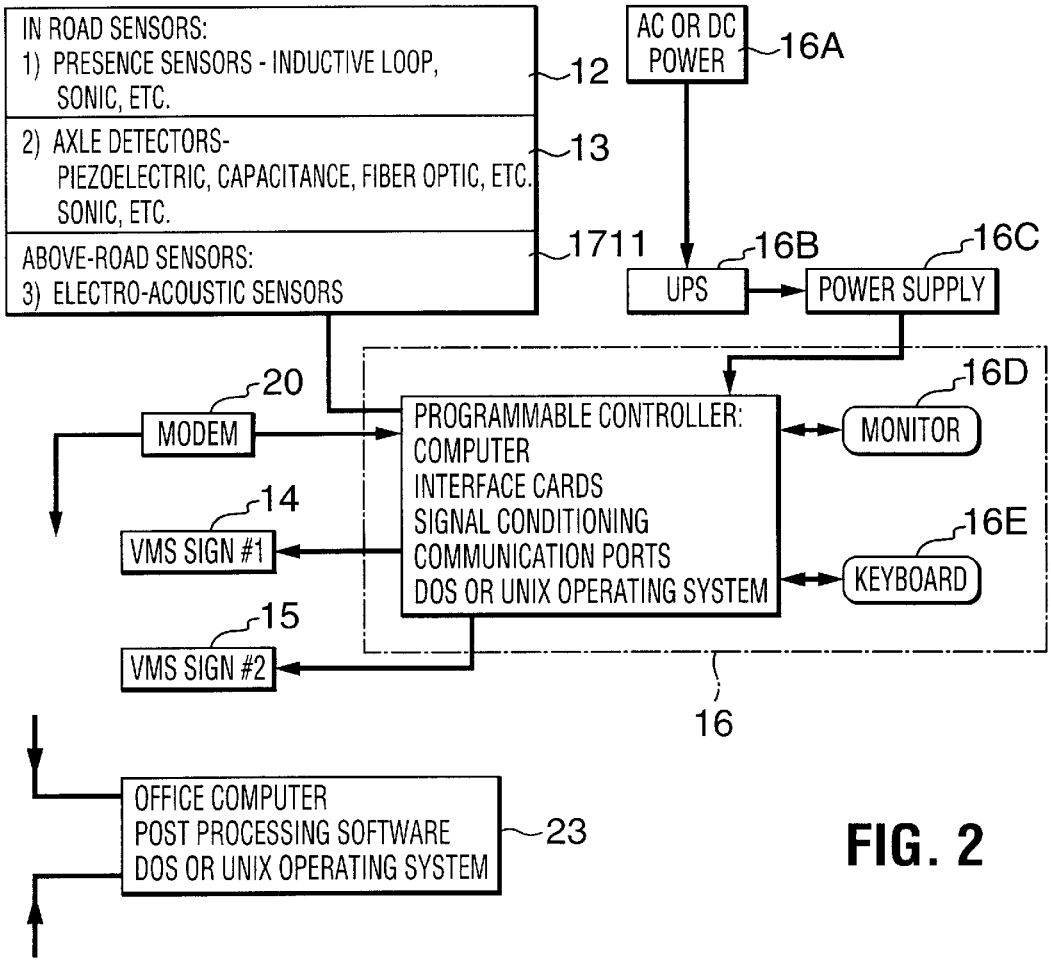
FIG. 2
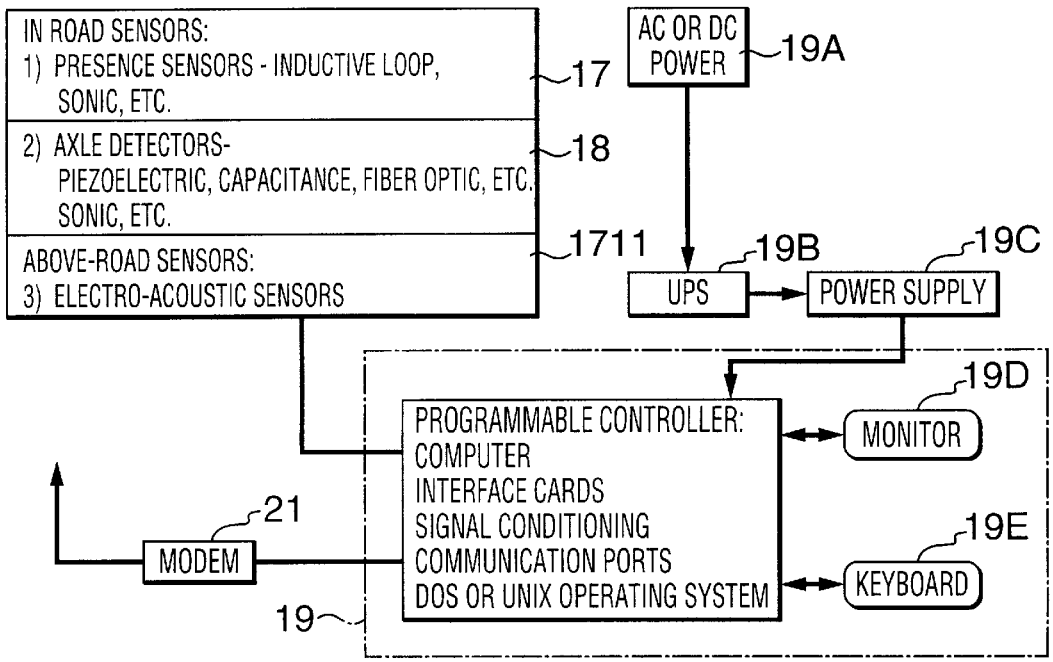

TRUCK TRAFFIC MONITORING AND WARNING SYSTEMS AND VEHICLE RAMP ADVISORY SYSTEM

BACKGROUND OF THE INVENTION (A) Field of the Invention

This invention relates to traffic monitoring systems including warning systems and vehicle ramp advisory systems, for monitoring commercial vehicles.

(B) Description of the Prior Art

Many kinds of systems have been disclosed which monitor and/or control traffic. Typically, each highway department had a command centre that received and integrated a plurality of signals which were transmitted by monitoring systems which were located along the highway. Although different kinds of monitoring systems were used, the most prevalent system employed was a roadway metal detector. In such system, a wire loop was embedded in the roadway and its terminals were connected to detection circuitry that measured the inductance changes in the wire loop. Because the inductance in the wire loop was perturbed by a motor vehicle (which included a quantity of ferromagnetic material) passing over it, the detection circuitry detected when a motor vehicle was over the wire loop. Based on this perturbation, the detection circuity created a binary signal, called a "loop relay signal", which was transmitted to the command centre of the highway department. The command centre gathered the respective loop relay signals and from these made a determination as to the likelihood of congestion. The use of wire loops was, however, disadvantageous for several reasons.

First, a wire loop system did not detect a motor vehicle unless the motor vehicle included sufficient ferromagnetic material to create a noticeable perturbation in the inductance in the wire loop. Because the trend now is to fabricate motor vehicles with non-ferromagnetic alloys, plastics and composite materials, wire loop systems will increasingly fail to detect the presence of motor vehicles. It is already well known that wire loops often overlook small vehicles. Another disadvantage of wire loop systems was that they were expensive to install and maintain. Installation and repair required that a lane be closed, that the roadway be cut and that the cut be sealed. Often too, harsh weather precluded this operation for several months.

Other, but non-invasive, traffic monitoring systems have also been suggested, among them being the following:

U.S. Pat. No. 3,047,838, patented Jul. 31, 1962 by G. D. Hendricks, provided a traffic cycle length selector which automatically related the duration of a traffic signal cycle to the volume of traffic in the direction of heavier traffic along a thoroughfare. The Hendricks system did not teach the use of electro-acoustic transducers, but instead used pressure-sensitive detectors. While Hendricks employed plural, non-electro-acoustic transducers, the traffic cycle length selector system did not include spatial discrimination circuitry. Hendricks merely described the use of the output of several spatially discriminate detectors to generate a spatially indiscriminate signal.

U.S. Pat. No. 3,233,084, patented Feb. 1, 1996, by H. C. Kendall et al, was directed to a method and apparatus for obtaining traffic data. That invention utilized the output of a vehicle detector as a triggering input to a circuit which then provided an output which was the same for all vehicles. The successive output pulses produced by a succession of vehicles passing the detection point were filtered and averaged so that the resultant signal had its amplitude which was proportional to the number of vehicles passing the detection point in a unit of time.

U.S. Pat. No. 3,275,984, patented Sep. 27, 1966, by J. L. Barker, disclosed a system which detected when traffic was moving too slowly, thereby indicating that a highway was becoming congested, and activated a sign near a highway exit to divert traffic via that exit.

U.S. Pat. No. 3,397,304, patented Aug. 13, 1968, by J. J. Auer, Jr., was directed to a method and apparatus for measuring vehicular traffic. The apparatus measured the traffic parameter of lane occupancy, i.e., the percentage of pavement which was vehicle-occupied. A vehicle presence detector controlled the addition of signals at a constant rate, to a signal accumulating means throughout each vehicle detection interval. At the same time, a signal was being subtracted continually from the signal accumulating means at a rate which was proportional to the present value of the signal which was stored in the signal accumulating means. The magnitude of the stored signal at each moment represented lane occupancy.

U.S. Pat. No. 3,445,637, patented May 20, 1969 by J. M. Auer, Jr., provided apparatus for measuring traffic density in which a sonic detector produced a discrete signal which was inversely proportional only to vehicle speed for each passing vehicle. A meter, which was responsive to the discrete signals, produced a measurement which was representative of traffic density. However, this patent used only a single electro-acoustic transducer for receiving acoustic signals within a detection zone, and did not teach spatial discrimination circuitry for representing acoustic energy emanating from a detection zone.

U.S. Pat. No. 3,544,958, patented Dec. 1, 1970, by L. J. Carey et al, disclosed a system which measured the time taken for a vehicle to traverse the distance between two light beams, and displayed the measured vehicle speed on a warning sign ahead of the vehicle.

U.S. Pat. No. 3,680,043, patented Jul. 25, 1972, by P. Angeloni, disclosed vehicle speed monitoring systems. Such system included posting devices which were positioned at intervals along the highway and which were adapted to receive a speed message from a control station, and to transmit the speed message to passing vehicles in a limited region of the highway in the form of an r-f signal. Each vehicle contained an r-f receiver which was connected to the vehicle speedometer, or other vehicle indication means, in a manner that provided, upon the occurrence of some predetermined excessive speed, an indication to the driver of the vehicle that the speed limit at that particular region of the highway was being exceeded.

U.S. Pat. No. 3,788,201, patented Jan. 29, 1974, by F. Abell, provided a method for establishing vehicle identification, speed and conditions of visibility. The patented method produced a photographic record showing the identification of a moving vehicle, its speed, conditions of visibility, date and time. Conditions of visibility were established by periodically making a first photographic record of a target at a selected location along a highway. In one embodiment, identification and speed were established in a second photographic record by simultaneously photographing a vehicle moving along the highway in the vicinity of the target and a radar speed meter indicating the speed of the photographed vehicle. In a second embodiment, identification and speed were established by taking two pictures with the same photographic means of the identical portion of a moving vehicle in the vicinity of the target at a known time interval in order to make up a second photographic record, and measuring the relative sizes of the image of the identical portion of the vehicle in the two pictures. Thereafter the speed of the vehicle was calculated by interrelating the time interval and vehicle image sizes with the image size of an object in a picture taken by the photographic means located at a known distance from the object. The object had an actual dimension corresponding to an actual dimension of the portion of the moving vehicle appearing in the second photographic record. The first and second embodiments for establishing identification and speed could be combined for purposes of corroborating the speed of the moving vehicle. Date and time were established by simultaneously photographing in all exposures making up the first and second photographic records date and time means showing the date and time at which the exposures are made.

U.S. Pat. No. 3,835,945, patented Sep. 17, 1974, by M. Yamanaka et al provided a device for weighing running vehicles. That device measured the weight of a moving vehicle by measuring either the wheel load or axle load. It avoided inaccuracies due to vibration through the use of means for producing two signals which were proportioned to the downward force on the near and far edges of a platform as the wheel or wheels passed over it. It then averaged the weight for a period which was initiated when the ratio of the signals had a first value and terminated when the ratio of the signals had a second value.

U.S. Pat. No. 3,920,967, patented Nov. 18, 1975, by D. T. Martin et al, provided a computerized traffic control apparatus for controlling the flow of vehicular traffic through a network of intersections. Detectors in proximity to selected intersections generated electrical signals which were representative of the commencement and termination of vehicle presence. One or more field preprocessor received these signals and responsively generated secondary signals which were representative of vehicle count and speed. These secondary signals were transmitted to a computer which analyzed them and responsively generated control signals which were transmitted to, and governed, the sequential operation of traffic signal heads at controlled intersections.

U.S. Pat. No. 3,927,389, patented Dec. 16, 1975, by V. Neeloff, disclosed a system which counted the number of axles on a vehicle to enable classification of the vehicle and the calculation of an appropriate tariff for use of a toll road.

U.S. Pat. No. 3,983,531, patented Sep. 28, 1976, by T. B. Corrigan, disclosed a system, which measured the time taken for a vehicle to pass between two loop detectors and operated a visual or audible signal if the vehicle exceeded a set speed limit.

U.S. Pat. No. 4,049,069, patented Sep. 20, 1977, by R. Tamarura et al, provided a device for weighing running vehicles. That apparatus included a series of platforms with the length of each platform being shorter than the distance between axles. Means were provided for converting displacement of the platforms to electrical signals. Electronic means were provided for averaging the signals which were produced by the individual axle loads to produce the weight of the vehicle.

U.S. Pat. No. 4,163,283, patented Jul. 31, 1978, by R. A. Darby, provided an automated method to identify aircraft type. In that invention, two sensors were spaced at a known separation to produce signal pulses when activated by the wheels of a taxiing aircraft. The signals were transmitted to a processor in which the wheelbase of the aircraft could readily be calculated. Since specific aircraft types have unique wheelbase dimensions and characteristics, the type of aircraft passing the sensors was determined in a processor. Also, the time, direction, and speed of the aircraft were determined and logged by the processor.

U.S. Pat. No. 4,250,483, patented Feb. 10, 1981, by A. C. Rubner, provided a system for signalized intersection control. The patented coordinated traffic signal control system included a plurality of signalized intersections with controllers including coordination means to relate cycle timing between intersections without dedicated interconnecting communication channels. Coordination means including radio receiver tuned to receive broadcast standard time, cycle timers related to data from broadcast time after iterative broadcast data check, signal cycle program selection from a plurality of programmable signal cycle program data inputs with cycle length and offset selection through time of day or traffic count program outputs. Such a system provided fixed cycle timing relationship with other similarly equipped intersections that responded to anticipated or detected changes in traffic patterns.

U.S. Pat. No. 4,251,797, patented Feb. 17, 1981, by P. Bragas et al, provided a vehicular direction guidance system, particularly for interchange of information between road mounted units and vehicle mounted equipment. In that system, a circuit was provided to detect the direction of movement of the vehicle with respect to a fixed road-mounted loop, which could then extend over opposing lanes of a highway network. The direction detecting equipment was mounted either on the vehicle, or was connected to the road mounted unit so that correct destination guidance information could be transmitted to vehicles passing a loop which was embedded in the roadway upon transmitting from the vehicle to the roadway a target or destination code.

U.S. Pat. No. 4,284,971, patented Aug. 18, 1981, by E. G. Lowry et al, provided an overheight vehicle detection and warning system. The patented system was for alerting drivers of vehicles which had an overall height which was too great to clear an overhead obstruction in their path. Respective pairs of cooperating light sources and light sensors were spaced at appropriate distances from each other and in advance of the overhead structure, with the light beam from each light source being directed to the corresponding light sensor with which such light source was paired. The respective light beans were momentarily interrupted or broken as a vehicle having an excessive overall height passed the successive pairs of light sources and light sensors. When the light beams had been broken in sequence and within a preset, given time period, a signal was sent to the control station which, in turn, activated a visible, flashing, electric sign indicating that the approaching vehicle was too high to clear the obstruction, and warning the driver of the vehicle to stop or exit from the thoroughfare. If the light beams were not broken in sequence within the preset time period, the system automatically cleared and reset itself to ready status. A message of the overheight vehicle could be transmitted to the proper highway authorities simultaneously with the activation of the warning sign. A mechanical sensor could be located on the overhead structure, with an associated camera to take a picture of the vehicle if the driver failed to stop and collision with the overhead structure occured. A collision message could also be transmitted to proper highway authorities.

U.S. Pat. No. 4,560,016, patented Dec. 24, 1985, by P. Ibanez et al, provided a method and apparatus for calculating the weight of a vehicle while it is in motion. An optical fiber was embedded into a matrix and a multiplicity of microbending fixtures were distributed along the path of the optic fiber. Then, as the wheels of a vehicle passed over the pad, the force of the wheels caused the microbending fixtures over which they passed to pinch together and attenuate the light which was transmitted through the optic fiber. The light which was transmitted through the optic fiber from a light source at one end of the optic fiber was received by a light receiver at the other end of the optic fiber. Then, by measuring the amount of light input and the net amount of light output, and calibrating the device, the weight of each axle and the weight of the vehicle above that axle was measured. By successively measuring the weight of each such axle and its associated portion of the vehicle as it passed over the pad, the combined weight of the axles were linearly added together to arrive at the total weight of the vehicle.

U.S. Pat. No. 4,591,823, patented May 27, 1986, by G. T. Horvat, disclosed a complicated system using radio transceivers which were located along the roadway which broadcast speed limit signals by transceivers carried by passing vehicles. Signals returned by the vehicle mounted transceivers enabled the roadside transceivers to detect speed-violations and to report them to a central processor via modem or radio.

U.S. Pat. No. 4,727,371, patented Feb. 23, 1988, by R. M. Wulkowicz, provided a traffic control system and devices for alleviating traffic flow problems at roadway junction. Such system included a first detector for detecting the position of a first vehicle along a first vehicle path. The system included a dynamic roadway sign for displaying the junction, the vehicle paths and the relative position of the first vehicle to the junction. The dynamic roadway sign was positioned along a second vehicle path, to be visible to any vehicles on the second vehicle path approaching the junction. The dynamic roadway sign was positioned sufficiently prior to the junction to allow sufficient time for vehicles travelling on the second vehicle path to act without abrupt manuevers to avoid collision with the first vehicle at the junction. The dynamic roadway sign included a graphic display of the junction for the vehicle paths, and icons which were positioned in sequence in one of the vehicle paths. Each of the icons were illuminated to indicate the presence of a vehicle at a pre-determined position on the vehicle path and its relative position to the junction.

U.S. Pat. No. 4,750,129, patented Jun. 7, 1988, by J. Hemstmengel et al, was directed to the production of an alarm signal on the basis of data obtained only from the speed of a vehicle which had actually overtaken a slower vehicle. Consequently, speed-limited signals were only produced by signal display arrangements to warn the overtaking vehicle if there was a real risk of a collision.

U.S. Pat. No. 4,789,941, patented Dec. 6, 1985, by B. Nunberg, provided a computerized ultrasonic vehicle classification system. That system was adapted for classification of vehicular traffic, as at a toll collection booth. An ultrasonic ranging unit was mounted above the traffic lane, facing downward. The unit was activated by the presence of a vehicle and proceeded to measure repetitively the momentary vertical distance of the vehicle from the ranging unit. Processing circuitry was provided to ascertain average and maximum height, rejecting aberrational readings. The computerized system included a "look-up" of standard vehicular categories, enabling classification of vehicles by comparison of the data received with pre-programmed standard categories.

U.S. Pat. No. 4,793,429, patented Dec. 27, 1988, by R. J. Bratton et al, provided a dynamic vehicle-weighing system. In that system, one or more piezoelectric weight sensors produced charge outputs in response to the weight of a vehicle passing over the sensors. A charge amplifier converted the sensor outputs to a voltage level. A peak voltage detector detected the peak voltage, which represented the sum of all sensor outputs. The peak voltage was then converted to a weight value using the thickness sensitivity of the piezoelectric material.

U.S. Pat. No. 4,806,931, patented Feb. 21, 1985, by T. M. Nelson, provided a sound pattern discrimination system. The patented system was provided for the detection and recognition of pre-established sound patterns, e.g., the various patterns produced by the sirens of emergency vehicles. The system included a microprocessor which was programmed with pre-established sequence detection algorithms corresponding to the different types of emergency vehicles sirens signal patterns which were to be recognized. A first omni-directional microphone was coupled thorough a bandpass circuit to a trigger circuit to produce square wave signals which were representative of analog signals in the band of interest. At least two directional microphones were coupled through similar bandpass amplifier circuits to analog digital converters which produced a digital output which was representative of the strength of the signals which were received by the directional microphones. This directional information along with the output of a Schmitt trigger, was supplied to the microprocessor which was used to control the signal lights at an intersection in response to the detected siren.

U.S. Pat. No. 4,908,616, patented Mar. 13, 1990, by J. P. Walker, disclosed a simple system to operate regular traffic signals or warning signs which were deployed at a traffic-signal-controlled intersection. A warning device was positioned in the approach to the intersection at a "reaction point" and gave an indication to a driver as to whether or not that vehicle was too close to the intersection to stop safely if the traffic signal had just changed. The system did not measure vehicle speed and could account for differing stopping distances for different classes of vehicle.

U.S. Pat. No. 5,008,666, patented Apr. 16, 1991, by F. J. Gebert et al., disclosed traffic measurement equipment employing a pair of coaxial cables and a presence detector for providing measurements including vehicle count, vehicle length, vehicle time of arrival, vehicle speed, number of axles per vehicle, axle distance per vehicle, vehicle gap, headway and axle weights.

U.S. Pat. No. 5,060,206, patented Oct. 22, 1991 by F. C. de Metz Sr., provided a marine acoustic detector for use in identifying a characteristic airborne sound pressure field which was generated by a propeller-driven aircraft. The detector included a surface-buoyed resonator chamber which was tuned to the narrow frequency band of the airborne sound pressure field and which had a dimensioned opening which was formed into a first endplate of the chamber for admitting the airborne sound pressure field. Mounted within the resonator chamber was a transducer circuit comprising a microphone and a preamplifier. The microphone functioned to detect the resonating sound pressure field within the chamber and to convert the resonating sound waves into an electrical signal. The pre-amplifier functioned to amplify the electrical signal for transmission via a cable to an underwater or surface marine vehicle to undergo signal processing. The sound amplification properties of the resonator air chamber were exploited in the passive detection of propeller-driven aircraft at airborne ranges exceeding those ranges of visual or sonar detection to provide 44 dB of received sound amplification at common aircraft frequencies below 100 Hz. However, this patent used only a single electro-acoustic transducer for receiving acoustic signals within a detection zone, and did not teach spatial discrimination circuitry for representing acoustic energy emanating from a detection zone.

U.S. Pat. No. 5,109,224, patented Apr. 28, 1992, by D. Lundberg, provided a road traffic signalling system. The patented system was for signalling individually to a vehicle driver in a flow of traffic that he was too close in relation to his speed to the vehicle ahead. The system comprises a succession of interconnected electronic signalling units of the "cat's eye" type which were positioned at intervals along the road. Each signalling unit detected and timed the passage of vehicles past the unit, determined the distance to the vehicle ahead and communicated with adjacent units. Signalling to the driver may be direct by light signals emitted from units in front of his vehicle, or indirect by transmitting a local signal from each unit for detection by vehicle-borne receivers. The Lundberg sensors merely detected vehicle presence and the processor, using the distance between sensors, then computed the speed of the vehicle. Lundberg's system detected the speeds both of a lead vehicle and a following vehicle and used "pre-programmed rules" to determine whether or not the following vehicle was too close for its speed. If it was, the processor lighted up the cat's eyes in the road ahead to warn the driver of the following vehicle to slow down. The maximum safe speed was obtained from a table which listed several different maximum speeds for different weather conditions. Lundberg's system merely selected a maximum speed from that table regardless of the type of vehicle.

U.S. Pat. No. 5,146,219, patented Sep. 8, 1992, by W. Zechnall, provided a device for the output of safety-related road information in locating and navigating systems of land vehicles. The patented information output device was for a computerized locating and navigating system of motor vehicles which, in addition to stored geographical data of an electronic road map, delivered safety-related information concerning determined sections of road. The information was stored and given out, e.g., optically or acoustically, when reaching the sections of road.

U.S. Pat. No. 5,231,393, patented Jul. 27, 1993, by B. F. Strickland, provided a mobile speed awareness device. That speed awareness device allowed passing traffic to perceive their true speed from a source other than their own speedometers. A trailer supported a container within which a radar source was contained and was operatively connected to a display panel. A suitable source of power operated the radar and display and included a battery, an optional photo voltaic source to power the battery and a plurality of instrumentalities to preclude or render less likely that the trailer will be moved by unauthorized personnel. These instrumentalities included a removable trailer hitch, an axle lock, support stands for elevating the trailer and an internal alarm system.

U.S. Pat. No. 5,250,946, patented Oct. 5, 1993, by D. Stanzcyk, provided a device for estimating the behaviour of crowd users. In that device, each person was the driver of a moving body. The device measured the average speeds of a same group or more generally of different groups in one location or at different locations. The device included a casing which was concealable inside an envelope which included a display unit which was programmable by the threshold of the selected speed, and alternatively, two counters, one indicating the number of moving bodies exceeding the threshold value and the other counter indicating the total number of moving bodies. The components included a Doppler sensor, an amplification stage, a logic stage for the control of the counters, and a power source (i.e., batteries). The device and method for the measurement of average speeds of road users was used in relation to traffic security, and to the measurement of instantaneous speeds, of lengths of the bodies and to their classification in relation to rolling bodies on roads.

U.S. Pat. No. 5,315,295, patented May 24, 1994, by Y. Fujii provided a vehicle speed control system. The patented vehicle speed control system was used, with a vehicle navigation system, for indicating a location of the vehicle on a road map as the vehicle traveled and for providing information related to the road, including curves of the road. The vehicle speed control system received information which was related to curves of a road on which the vehicle navigation system indicated that the vehicle location was before the curve. The system calculated a limit vehicle speed, at which the vehicle can negotiate and pass safely through the curve, based on the vehicle speed and the radius of curvature of the curve. When the vehicle speed was higher than the limit vehicle speed, the vehicle speed control system provided a warning and/or automatically braked the vehicle, or automatically closed a throttle of the vehicle, so as to lower cause the vehicle speed to fall below the limit vehicle speed.

The known systems did not, however, deal with the fact that a particular site will not be a hazard for one type of vehicle, for example an automobile, but will be a hazard for a truck. When commercial vehicles, especially large trucks, are involved in accidents, the results are often tragic. Statistics show that, although commercial vehicles are involved in a relatively small percentage of all motor vehicle accidents, they are involved in a higher percentage of fatal accidents than other vehicles. Consequently, they warrant special monitoring.

U.S. Pat. No. 5,617,086, patented Apr. 1, 1997, by R. Klashinsky et al, and assigned to International Road Dynamics Inc., provided an improved traffic monitoring system which was especially suited to monitoring commercial vehicles. That invention was concerned with assessing whether or not the site constituted a hazard for a particular vehicle depending upon its size, weight, speed and the like. The essence of that invention was to use a variable parameter (vehicle speed) and a fixed parameter (vehicle weight) to provide information relative to the maximum speed at which a hazard may be safely negotiated based upon the site-specific data of that hazard.

That invention was therefore concerned with the fact that a hazard (e.g., a particular curve, incline, controlled intersection, or the like) will not be a hazard for one type of vehicle, for example an automobile, travelling at a particular speed, but will be a hazard for another type of vehicle, for example, a truck travelling at the same speed. Recognizing this, that system had sensors to measure the weight and, if desired, one or more other physical parameters of the vehicle, e.g., height, number of axles or the like, and a processor for storing data specific to the site, e.g., severity of an incline, curvature and camber of a bend, or distance from the sensors to a controlled intersection.

The processor used both the particular vehicle data and the site-specific data to compute a maximum speed for that particular vehicle safely to negotiate that particular hazard. In essence, therefore, the system used the weight and, if desired, one or other more of the physical parameters of the vehicle to assess the forward momentum of that vehicle and to determine whether or not that vehicle can negotiate the hazard safely.

Several different embodiments of that invention were taught. One embodiment of that invention was directed to a traffic monitoring system which included a set of sensors which were disposed in a traffic lane approaching a hazard for providing signals which were indicative of the speed, and also indicative of at least the weight of a vehicle traversing the set of sensors. A processor had a memory for storing site-specific dimensional data related both to the hazard and to signals from the set of sensors. A traffic signalling device was associated with the traffic lane and was disposed downstream of the set of sensors, the traffic signalling device being controlled by the processor. The processor was responsive to the signals from the set of sensors for computing the actual vehicle speed. The processor also computed a maximum safe vehicle speed, which was derived from the site-specific dimensional data and from at least the weight of the vehicle. The computed maximum vehicle safe speed was thus the maximum speed for the vehicle safely to negotiate the hazard. The computed actual vehicle speed was compared with the computed maximum safe vehicle speed. The traffic signalling device was then operated if the computed actual vehicle speed exceeded the computed maximum safe vehicle speed.

Another embodiment of that invention was a traffic monitoring system for use in association with a traffic-signal-controlled intersection having a set of traffic signals and a traffic signal controller. The system included a plurality of sensors which was disposed in a traffic lane upstream of the traffic-signal-controlled intersection. The plurality of sensors included a final sensor which was disposed a predetermined distance in advance of the intersection, a preceding sensor which was disposed a predetermined distance preceding a final sensor in the direction of traffic flow, and a further sensor which sensed weight of the vehicle for providing signals indicative of the weight of the vehicle. A processor was included which had a memory for storing site-specific dimensional data including the predetermined distance. The processor was responsive to signals from the vehicle weight sensor, from the preceding sensor, and from the final sensor to compute a predicted vehicle speed at the final sensor. From the site-specific dimensional data, the processor then determined whether or not the predicted vehicle speed exceeded a computed maximum speed, at which speed the vehicle can safely stop at the intersection, should the traffic signals require it. If the vehicle cannot safely stop at the intersection, the processor transmitted a pre-emption signal to the traffic signal controller, thereby causing the traffic signal controller to switch, or to maintain, the traffic signal to afford right-of-way through the intersection to that vehicle.

Yet another embodiment of that invention provided a traffic monitoring system for determining potential rollover of a vehicle, The sensor comprised a set of sensor arrays which was disposed in a traffic lane approaching a curve and a vehicle height sensor. The site-specific data included characteristics of the curve, e.g., camber and curvature. The traffic signal device included a variable message sign which was associated with the traffic lane and which was disposed between the sensor arrays and the curve. The processor was responsive to the signals from the sensor array for computing, as the vehicle speed, a predicted speed at which the vehicle will be travelling on arrival at the curve, and derived a maximum safe speed for the particular vehicle to negotiate the curve safely on the basis of vehicle parameters, including weight and height. The processor compared the predicted speed with the maximum speed and operated the traffic signal to display a warning to the driver of the vehicle if the predicted speed exceeded the maximum safe speed. Such a system could be deployed, for example, at the beginning of an exit road from a highway, between the highway exit and a curved exit ramp, and would warn the driver of a tall vehicle was travelling so quickly that there would be a risk of rollover as it attempted to negotiate the curve. In such embodiment of that invention, it was necessary also to measure the height of the vehicle as it approached a curve, since the lateral momentum of the vehicle in the curve can be predicted to determine the safe speed at which the vehicle can negotiate the curve without rollover. Thus, the system of that invention computed a safe maximum speed for a particular vehicle in dependence upon, among other things, the weight and height of the vehicle.

Thus, the following systems have now been provided:

A truck rollover advisory system, which is a system designed to reduce truck rollover accidents which occur on highway exit ramps, in which in-road and off-road sensors determine individual truck speed, weight, height and type. From this real time data/information, the probability of a particular truck rolling over is computed by a controller. A warning sign is automatically activated if an unsafe configuration is detected.

A downhill truck speed advisory system, which is a variable message sign to advise individual trucks of a safe descent speed prior to beginning a long downhill grade, in which, as trucks approach the downhill grade, a controller computes individual truck weight and configuration and determines the maximum safe descent speed for that particular truck using FHWA (Federal Highway Administration) guidelines. A variable message sign displays the safe descent speed for individual trucks.

A runaway truck signal control system, which reduces the possibility of disastrous intersection accidents resulting from a runaway truck. As trucks proceed down a slope, the speed, weight and classification of each individual truck is determined. If the truck is travelling too fast to stop safely at the intersection downstream, a signal will be transmitted from a controller to the traffic signal lights. The lights will either hold or change to green until the oncoming truck travels through the intersection.

SUMMARY OF THE INVENTION

(A) Aims of the Invention

While these systems have adequately addressed the problems of truck rollovers, "runaway" trucks and downhill excess speed travel for trucks, some improvements are desirable. It would be desirable to provide a system which made maintenance more efficient without unduly disrupting the traffic on the roadway. Thus, the systems of the prior art as discussed above, are expensive to install and maintain. Moreover, installation and repair required that a traffic lane be closed, that the roadway be cut and that the cut be sealed. Often too, harsh weather can preclude this operation for several months.

STATEMENTS OF INVENTION

The present invention provides a traffic monitoring and warning system comprising (i) at least one set of sensors comprising a set of above-road electro-acoustic sensor arrays which is disposed above a traffic lane approaching a hazard for producing signals which are indicative of whether the vehicle is an automobile or a truck and, if it is a truck, to record the presence of the truck and to provide signals which are indicative of the speed of a truck traversing a detection zone of the above-road electro-acoustic sensor arrays; (ii) a processor having a memory for storing site-specific geometrical and/or dimensional data related both to the hazard and to signals which have been received from the at least one set of above-road electro-acoustic sensor arrays relating to the speed of the truck; and (iii) a traffic signalling device which is associated with the traffic lane and which is disposed downstream of the at least one set of above-road electro-acoustic sensor arrays, the traffic signalling device being controlled by the processor; the processor being responsive to the signals from the at least one set of above-road electro-acoustic sensor arrays for computing an actual speed of the truck and for computing a computed maximum safe speed of the truck, the computed maximum safe speed of the truck being derived from the site-specific geometrical and/or dimensional data, and from the computed actual speed of the truck, the computed maximum safe speed of the truck being the maximum speed for the truck safely to negotiate the hazard, the processor comparing the computed actual speed of the truck with the computed maximum safe speed for the truck; and the processor then automatically operating the traffic signalling device if the computed actual speed of the truck exceeds the computed maximum safe speed for the truck, and also discontinuing operating the traffic signalling device if the computed actual speed of the truck no longer exceeds the computed maximum safe speed for the truck.

The present invention also provides a traffic monitoring and vehicle ramp advisory system comprising (i) at least one set of sensors comprising a set of above-road electro-acoustic sensor arrays which is disposed above a traffic lane approaching a curve for producing signals which are indicative of whether a vehicle is an automobile or a truck, and, if it is a truck, to record the presence of the truck and to provide signals which are indicative of the speed of the truck; (ii) a processor having a memory for storing site-specific geometrical and/or dimensional data comprising characteristics of the curve and signals which have been received from the at least one set of above-road electro-acoustic sensor arrays relating to the speed of the truck; and (iii) a traffic signalling device which is associated with the traffic lane and which is disposed downstream of the at least one set of above-road electro-acoustic sensor arrays, the traffic signalling device being controlled by the processor; the processor being responsive to signals from the at least one set of above-road electro-acoustic sensor arrays for computing an actual speed at which the truck will be travelling on arrival at the curve, and for deriving a computed maximum safe speed for the truck safely to negotiate the curve on the basis of the site-specific data of the curve and of the computed actual speed of the truck as determined by the at least one set of above-road electro-acoustic sensor arrays, the processor comparing the computed actual speed of the truck with the computed maximum safe speed for the truck; and the processor then automatically operating the traffic signalling device if the computed actual speed of the truck exceeds the computed maximum safe speed for the truck, to operate the traffic signalling device to display a warning to a driver of the truck if the computed actual speed of the truck exceeds the computed maximum safe speed for the truck, and discontinuing operating of the traffic signalling device if the computed actual speed of the truck no longer exceeds the computed maximum safe speed for the truck.

The present invention further provides a traffic monitoring and traffic light pre-emption system comprising (i) at least one set of sensors comprising a set of above-road electro-acoustic sensor arrays which is disposed above a traffic lane approaching a traffic-signal-controlled intersection for producing signals which are indicative of whether a vehicle is an automobile or a truck, and, if it is a truck, to record the presence of the truck and to provide signals which are indicative of the speed of the truck, the set of above-road electro-acoustic sensor arrays being disposed a predetermined distance from the traffic-signal-controlled intersection, the traffic lane being either level or being on a downgrade; (ii) a processor for storing data including the predetermined distance, the processor being responsive to the signals from the above-road electro-acoustic sensor arrays, to site-specific data and to such predetermined distance, to compute an actual speed of the truck when it approaches the traffic-signal-controlled intersection and to compute a maximum speed of the truck, from which the truck can safely stop at the traffic-signal-controlled intersection should the traffic signals require the truck to do so, and then to determine whether or not the computed actual speed of the truck exceeds a maximum speed of the truck from which the truck can safely stop at the traffic-signal-controlled intersection should the traffic signals require the truck to do so; the processor transmitting a pre-emption signal to the traffic-signal-controller causing the traffic signal controller to switch, or to maintain, the traffic signal to afford right of way through the intersection to the truck in the event that the computed actual speed of the truck exceeds the computed maximum safe speed for the truck to stop at the traffic-signal-controlled intersection.

The present invention still further provides a traffic monitoring and warning system for a downgrade comprising (i) a first set of sensors comprising a set of above-road electro-acoustic sensor arrays which is disposed above a traffic lane approaching a downgrade for producing signals which are indicative of whether a vehicle is an automobile or a truck, and if it is a truck, to record the presence of the truck and to provide signals which are indicative of the actual speed of the truck; (ii) a processor having a memory for storing site-specific dimensional data related to the downgrade and including the length and severity of the downgrade, and for storing signals from the set of above-road electro-acoustic sensor arrays which are indicative of the actual speed of the truck; and (iii) a traffic signalling device which is associated with the traffic lane and which is disposed downstream of the at least the first set of above-road electro-acoustic sensor arrays, the traffic signalling device comprising either traffic signal lights or a message sign, the traffic-signalling device being controlled by the processor; the processor being responsive to the signals from the at least the first set of above-road electro-acoustic sensor arrays for computing the actual speed of the truck and for computing a computed maximum safe speed for the truck to descend the downgrade which is derived from the site-specific dimensional data and from the actual speed of the truck, the computed maximum safe speed of the truck being a maximum safe speed for the truck safely to descend the downgrade; the processor, by comparing the computed actual speed of the truck with the computed maximum safe speed for the truck, then operating the traffic-signal lights or the message sign only if the computed actual speed of the truck exceeds the computed maximum safe speed for the truck to descend the downgrade by transmitting a control signal to the traffic-signal lights or to the message sign, thereby controlling the traffic signal lights for a time which is sufficient to allow the truck to descend the downgrade or controlling the message sign to display the maximum safe speed for the truck for a period of time during which the message sign is visible to a driver of the truck, and to discontinue the display of the message sign thereafter.

The present invention yet further provides a traffic monitoring and warning system for a blind intersection, the traffic monitoring and warning system comprising (i) at least one set of sensors comprising a set of above-road electro-acoustic sensor arrays which is disposed above a traffic lane for producing signals which are indicative of whether a vehicle is an automobile or a truck, and, if it is a truck, to record the presence of the truck and to provide a set of signals which are indicative of the speed of the truck, the set of sensors being disposed in a traffic lane upstream of the blind intersection, and being disposed a predetermined distance in advance of that blind intersection; (ii) a processor having a memory for storing site-specific dimensional data including the predetermined distance, the processor being responsive to signals from the above-road electro-acoustic sensor arrays for computing a predicted speed of the truck at the blind intersection, and for computing a maximum safe speed for the truck to stop at said blind intersection if required to do so, and being responsive to signals from the site-specific dimensional data to determine whether or not the predicted speed of the truck at the blind intersection exceeds the computed maximum safe speed of the truck at which speed the truck can safely stop at the blind intersection; the processor then transmitting a signal to a traffic warning sign at the blind intersection to actuate the warning sign to afford right of way through the blind intersection to the truck in the event that the computed actual speed of the truck exceeds the computed maximum safe speed for the truck to stop at the blind intersection, and for deactivating the warning sign when the truck traverses the blind intersection.

The present invention yet further provides a method of automatically controlling the operation of a traffic signalling device which is associated with a hazard by analyzing data from any of the systems as disclosed above, the method including the steps of (i) downloading, into a processor, a set of records of the speed of the truck which is derived from a first set of above-road electro-acoustic sensor arrays which is disposed upstream of the hazard; (ii) downloading, into the processor, a set of records of a computed speed of the truck downstream of the first set of above-road electro-acoustic sensor arrays of the hazard; (iii) matching records, by the processor, of the two speeds of the truck from both the sets of records; (iv) computing, by the processor, and from such sets of records, an actual speed of the truck and a computed maximum safe speed for the truck, and comparing these two speeds; (v) automatically operating, by the processor, the traffic signalling device if the computed actual speed of the truck exceeds the computed maximum safe speed of the truck, to display a warning to a driver of the truck when the computed actual speed of the truck exceeds the computed maximum safe speed of the truck; and (vi) discontinuing, by the processor, operating the traffic signalling device if the computed actual speed of the truck no longer exceeds the estimated maximum safe speed for the truck.

The present invention yet still further provides a method of automatically controlling the operation of a traffic signalling device which is associated with a hazard by analyzing data from any of the systems as disclosed above, the method including the steps of (i) downloading, into a processor, a set of records of the speeds of a truck which is derived from a first set of above-road electro-acoustic sensor arrays which is disposed upstream of the hazard; (ii) downloading, into the processor, a set of records of the speed of the truck which is derived from a second set of above-road electro-acoustic sensor arrays which is disposed downstream of the first set of above-road electro-acoustic sensor arrays but upstream of the hazard; (iii) matching records, by the processor, of the two speeds of the truck from both sets of records; (iv) computing, by the processor, and from the sets of records, an actual speed of the truck and the computed maximum safe speed for the truck, and comparing these two speeds; (v) automatically operating, by the processor, the traffic signalling device if the computed actual speed of the truck exceeds the computed maximum safe speed of the truck, to display a warning to a driver of the truck when the computed actual speed of the truck exceeds the computed maximum safe speed of the truck; and (vi) discontinuing, by the processor, operating the traffic signalling device if the computed actual speed of the truck no longer exceeds the actual maximum safe speed of the truck.

The present invention yet still further provides a method of automatically controlling the operation of a traffic signalling device which is associated with a curve by analyzing data from any of the systems as disclosed above, the method comprising the steps of (i) downloading, into a processor, a set of records of including rollover threshold data and the speed of the truck derived from a first set of above-road electro-acoustic sensor arrays which is disposed upstream of the curve; (ii) downloading, into the processor, a set of records of a computed speed of the truck downstream of the first set of above-road electro-acoustic sensor arrays but upstream of the curve; (iii) matching records, by the processor, of the two speeds of the truck from both sets of records; (iv) computing, by the processor, and from the sets of records, an actual speed of the truck and a computed maximum safe threshold speed to prevent the truck from rollover from the rollover threshold data which has been downloaded into the processor; (v) computing, by the processor, a computed speed of the truck at the point of curvature of the curve; (vi) automatically operating, by the processor, the traffic signalling device if the computed actual speed of the truck exceeds the computed maximum safe threshold speed of the truck, to display a warning to a driver of the truck when the computed actual speed of the truck exceeds the computed maximum safe threshold speed of the truck; and (vii) discontinuing, by the processor, operating the traffic signalling device if the computed actual speed of the truck no longer exceeds the computed maximum safe speed for the truck.

The present invention still yet further provides a method of automatically controlling the operation of a traffic signalling device which is associated with a curve by analyzing data from any of the systems as disclosed above, comprising the steps of (i) downloading, into a processor, a set of records including rollover threshold data and the speed of the truck which is derived from a first set of above-road electro-acoustic sensor arrays which is disposed upstream of the curve; (ii) downloading, into a processor, a set of records of the actual speed of the truck from a second set of above-road electro-acoustic sensor arrays which is disposed downstream of the first set of above-road electro-acoustic sensor arrays but which is disposed upstream of the curve; (iii) matching records, by the processor, of the two speeds of the truck from both sets of records; (iv) computing, by the processor, and from the sets of records, an actual speed of the truck and a computed maximum safe threshold speed for the truck to prevent the truck from rolling over from the rollover threshold data which has been downloaded into the processor; (v) computing, by the processor, a computed speed of the truck at the point of curvature of the curve; (vi) automatically operating, by the processor, the traffic signalling device if the computed speed of the truck exceeds the computed maximum safe threshold speed of the truck, to display a warning to a driver of the truck when the computed speed of the truck exceeds the computed maximum safe threshold speed of the truck; and (vii) discontinuing, by the processor, operating the traffic signalling device if the computed speed of the truck no longer exceeds the computed maximum safe speed for the truck.

The present invention also provides a method of automatically controlling the operation of a traffic signalling device which is provided at an intersection by analyzing data from any of the systems as disclosed hereinabove, the method comprising the steps of (i) downloading, into a processor, a set of records including stopping threshold data and the actual speed of the truck which is derived from a first set of above-road electro-acoustic sensor arrays which is disposed upstream of the intersection; (ii) downloading, into the processor, a set of records of a computed speed of the truck which is derived from a second set of above-road electro-acoustic sensor arrays which is disposed downstream from the first set of above-road electro-acoustic sensor arrays but upstream of the intersection; (iii) matching records, by the processor, of the two speeds of the truck from both sets of records; (iv) computing, by the processor, and from the sets of records, an actual speed of the truck and a computed maximum stopping distance to enable the truck to stop, which is based on stopping threshold data and from a remeasured distance from the intersection which have been downloaded into the processor; (v) downloading, into the processor, the actual speed of the truck at the remeasured distance upstream from the intersection; (vi) determining, by the processor, whether the truck will be able to stop at the intersection before it reaches the traffic signalling device; and (vii) from that determination, then sending, by the processor, a signal to the traffic signalling device to operate the traffic signalling device to provide right of-way to enable the truck to cross the intersection, and discontinuing operating the traffic-signalling device when the truck crosses the intersection.

The present invention yet still further also provides a method of automatically controlling the operation of a traffic signalling device which is provided at an intersection by analyzing data from any of the systems as disclosed hereinabove, the method comprising the steps of (i) downloading, into a processor, a set of records including stopping threshold data and the actual speed of the truck which is derived from a first set of above-road electro-acoustic sensor arrays which is disposed upstream of the intersection; (it) downloading, into the processor, a set of records of the actual speed of the truck which is derived from a second set of above-road electro-acoustic sensor arrays which is disposed downstream of the first set of above-road electro-acoustic sensor arrays but upstream of the intersection; (iii) matching records, by the processor, of the two speeds of the truck from both sets of records; (iv) computing, by the processor, and from the sets of records, an actual speed of the truck and a computed maximum stopping distance to enable the truck to stop which is based on stopping threshold data and from the remeasured distance from the intersection traffic signalling device which have been downloaded into the processor; (v) downloading, into the computer, the actual speed of the truck at the remeasured distance upstream from the traffic signalling device; (vi) determining, by the processor, whether the truck will be able to stop at the intersection if required to so by the traffic signalling device; and (vii) from that determination, then sending, by the processor, a signal to the traffic signalling device to operate the traffic-signalling device to right-of-way to enable the truck to cross the intersection, and to discontinue operating the traffic-signalling device when the truck crosses the intersection.

The present invention still further provides a method for detecting and signalling the presence of a truck in a predetermined zone, and of determining the speed of the truck, the method comprising the steps of (i) receiving, with a first above-road electro-acoustic sensor array, a first acoustic signal which is radiated from a motor vehicle and converting the first acoustic signal into a first electric signal that represents the first acoustic signal; (ii) receiving, with a second above-road electro-acoustic sensor array, a second acoustic signal which is radiated from the motor vehicle and converting the second acoustic signal into a second electric signal that represents the second acoustic signal; (iii) creating, with spatial discrimination circuitry, a third electric signal, which is based on the sum of the first electric signal and the second electric signal such that the third signal is indicative of the acoustic energy emanating from the detection zone; (iv) creating, with interface circuitry, a binary loop relay signal which is based on the third electric signal such that the loop relay signal is asserted when the motor vehicle is within the detection zone and such that the loop relay signal is retracted when the motor vehicle truck is not within the detection zone; and (v) comparing the third electric signal to electrical signals from known trucks to determine whether the motor vehicle is a truck, and to compute the speed of the truck.

The present invention also still further provides a method for detecting trucks moving through a predetermined zone, and of determining the speed, and optionally, of determining the configuration of the truck, the method comprising the steps of (i) training a plurality of above-road electro-acoustic sensor arrays on the predetermined zone; (ii) filtering electrical signals from the plurality of above-road electro-acoustic sensor arrays; (iii) correlating at least two of the filtered electrical signals with one another; (iv) integrating the results of the correlation in the immediately-preceding step over time; (v) comparing the integrated result of the immediately-preceding step to a predetermined threshold and indicating detection of a motor vehicle when the threshold is exceeded by the integrated result; and (vi) comparing the third electric signal to electrical signals from known trucks to determine whether the motor vehicle is a truck, and to compute the speed of the truck and, optionally, also to compute and specify the configuration of the truck, including length, number of axles, spacing of axles and height.

The present invention yet further provides a method for providing traffic volume, line occupancy, per vehicle speed and vehicle classification of vehicles travelling along a highway which method comprises: receiving acoustic signals which are created and radiated by the vehicles as they travel through a detection zone; and signal processing the acoustic signals; thereby to provide the traffic volume, line occupancy, per vehicle speed and classification of vehicles.

OTHER FEATURES OF THE INVENTION

By a feature of the first two traffic monitoring systems of this invention, the signal for discontinuing the operation of the traffic signalling device is based on a timer, which is responsive to deceleration of the speed of the truck upon the driver of the truck acting on a warning which is provided by the traffic signalling device.

By another feature of the first two traffic monitoring systems of this invention, the system includes a second set of above-road electro-acoustic sensor arrays which is disposed downstream of the at least one set of above-road electro-acoustic sensor arrays but which is disposed upstream of the traffic signalling device, the second set of above-road electro-acoustic sensor arrays comprising a set of above-road electro-acoustic sensor arrays which is disposed above the traffic lane approaching the hazard, (i.e., the curve), for providing signals which are indicative of the speed of a truck traversing the second set of above-road electro-acoustic sensor arrays, a signal for discontinuing operating the traffic signalling device being provided by signals which are indicative of the speed of a truck traversing the second set of above-road electro-acoustic sensor arrays, the processor being responsive to such signals from the second set of above-road electro-acoustic sensor arrays to discontinue operating the traffic signalling device when the speed of the truck no longer exceeds the computed maximum safe speed for such truck.

By yet another feature of the first two traffic monitoring systems of this invention, the above-road electro-acoustic sensor arrays which are disposed above a traffic lane approaching the hazard, (i.e., the curve), also producing signals which are indicative of the configuration of the truck.

By still another feature of the first two traffic monitoring systems of this invention, the traffic monitoring system also includes a weigh-in-motion scale for supplementing the signals which are indicative of the speed of the truck with signals which are also indicative of the actual weight of the truck.

By a feature of the third, fourth and fifth traffic monitoring systems of this invention, the traffic monitoring system further includes a camera device which is actuatable on dependence upon a selected signal to capture an image of a truck causing the control signal. By a further feature thereof, the traffic monitoring system further includes a vehicle presence detector which is disposed downstream of the camera device for generating a signal, when traversed by the truck, for deactivating the camera device.

By another feature of the third, fourth and fifth traffic monitoring systems of this invention, the set of above-road electro-acoustic sensor arrays comprises (i) a first above-road electro-acoustic sensor array for receiving a first acoustic signal which is radiated from the truck at a predetermined zone and for converting the first acoustic signal into a first electric signal that represents the first acoustic signal; (ii) a second above-road electro-acoustic sensor array for receiving a second acoustic signal which is radiated from the truck at the predetermined zone and for converting the second acoustic signal into a second electric signal that represents the second acoustic signal; (iii) spatial discrimination circuitry for creating a third electric signal which is based both on the first electric signal and on the second electric signal, that substantially represents the acoustic energy emanating from the predetermined zone; (iv) frequency discrimination circuitry for creating a fourth signal which is based on the third signal; and (v) interface circuitry for creating an output signal which is based on the fourth signal such that the output signal is asserted when the truck is within the predetermined detection zone and whereby the output signal is retracted when the truck is not within the predetermined detection zone. By one further feature thereof, the frequency discrimination circuitry comprises a bandpass filter. By another further feature thereof, the frequency discrimination circuitry comprises a bandpass filter with a lower passband edge which is substantially close to 4 $KH_z$ and an upper passband edge which is substantially close to 6 KHz.

By yet another feature of the third, fourth and fifth traffic monitoring systems of this invention, the set of above-road electro-acoustic sensor arrays comprises (a) a plurality of above-road electro-acoustic sensor arrays which is trained on a predetermined zone; (b) a bandpass filter for processing electrical signals from the plurality of above-road electro-acoustic sensor arrays; (c) a correlator having at least two inputs and an output for correlating filtered versions of the electrical signals originating from at least two of the plurality of above-road electro-acoustic sensor arrays; (d) an integrator for integrating the output of the correlator means over time; and (e) a comparator for indicating detection of the truck when the integrated output exceeds a predetermined threshold. By one further feature thereof, the apparatus further includes a plurality of analog-to-digital convertors for converting the electrical signals to digital representations prior to the processing thereof. By another further feature thereof, the integrator and the comparator are each microprocessor-based programs. By yet another further feature thereof, the electro-acoustic sensor arrays comprise two vertical multiple-microphone elements and two horizontal multiple-microphone elements, and the correlator means has one of the at least two inputs receiving a sum of the two multiple-microphone vertical elements, and the other of the at least two inputs receiving a sum of the two horizontal multiple-microphone elements.

By yet another feature of the third, fourth and fifth traffic monitoring systems of this invention, the traffic signalling device comprises a fiber optic sign.

By a feature of any of the above methods of this invention, the method includes the step of downloading a set of records of the actual weight of the truck.

By another feature of any of the above methods of this invention, the method includes the step of addressing a video system to record truck passage at the traffic signalling device.

By a feature of the seventh and eighth methods of this invention, the method includes the step of converting the electrical signals to digital representations prior to the filtering.

By another feature of the seventh and eighth methods of this invention, the steps of integrating and comparing are each computational routines.

By yet another feature of the seventh and eighth methods of this invention, the plurality of electro-acoustic sensor arrays comprises two vertical multiple microphone elements and two horizontal multiple microphone elements, and the correlating step continuously correlates the sum of the two vertical multiple microphone elements with sums of the two horizontal multiple microphone elements.

By a feature of the ninth method of this invention, the method includes the step of using advanced signal and spatial processing to provide adaptive interference cancellation and high resolution multi-lane or multi-zone traffic monitoring, including shoulder activity.

By another variant thereof, the acoustic signals are received by means of a set of non-contact, passive acoustic (listen only) above-road electro-acoustic sensor arrays which is mounted on overhead or roadside structures.

DESCRIPTION OF THE FIGURES

BRIEF DESCRIPTION OF THE DRAWINGS

Figure 1:
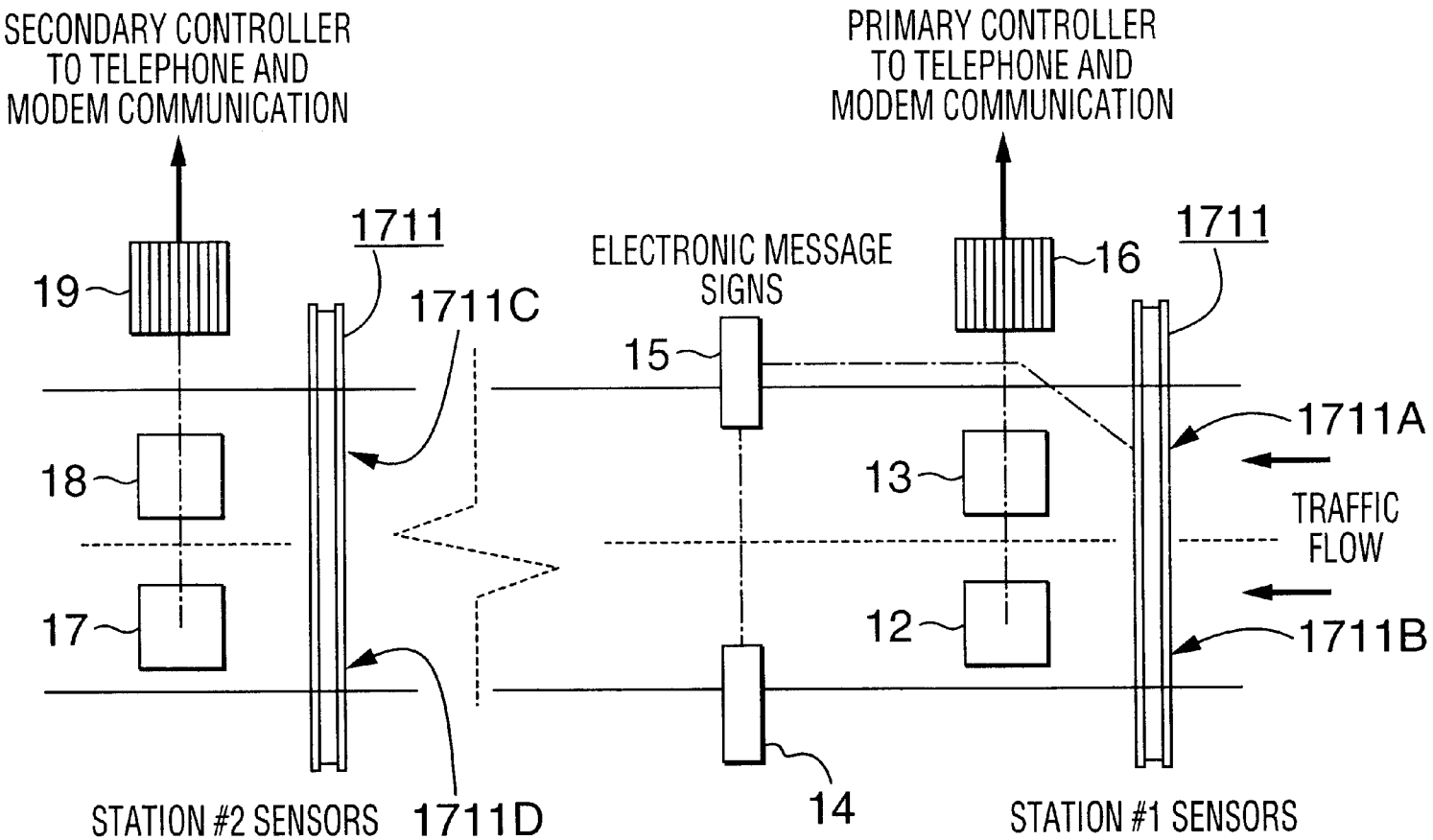
Figure 3:
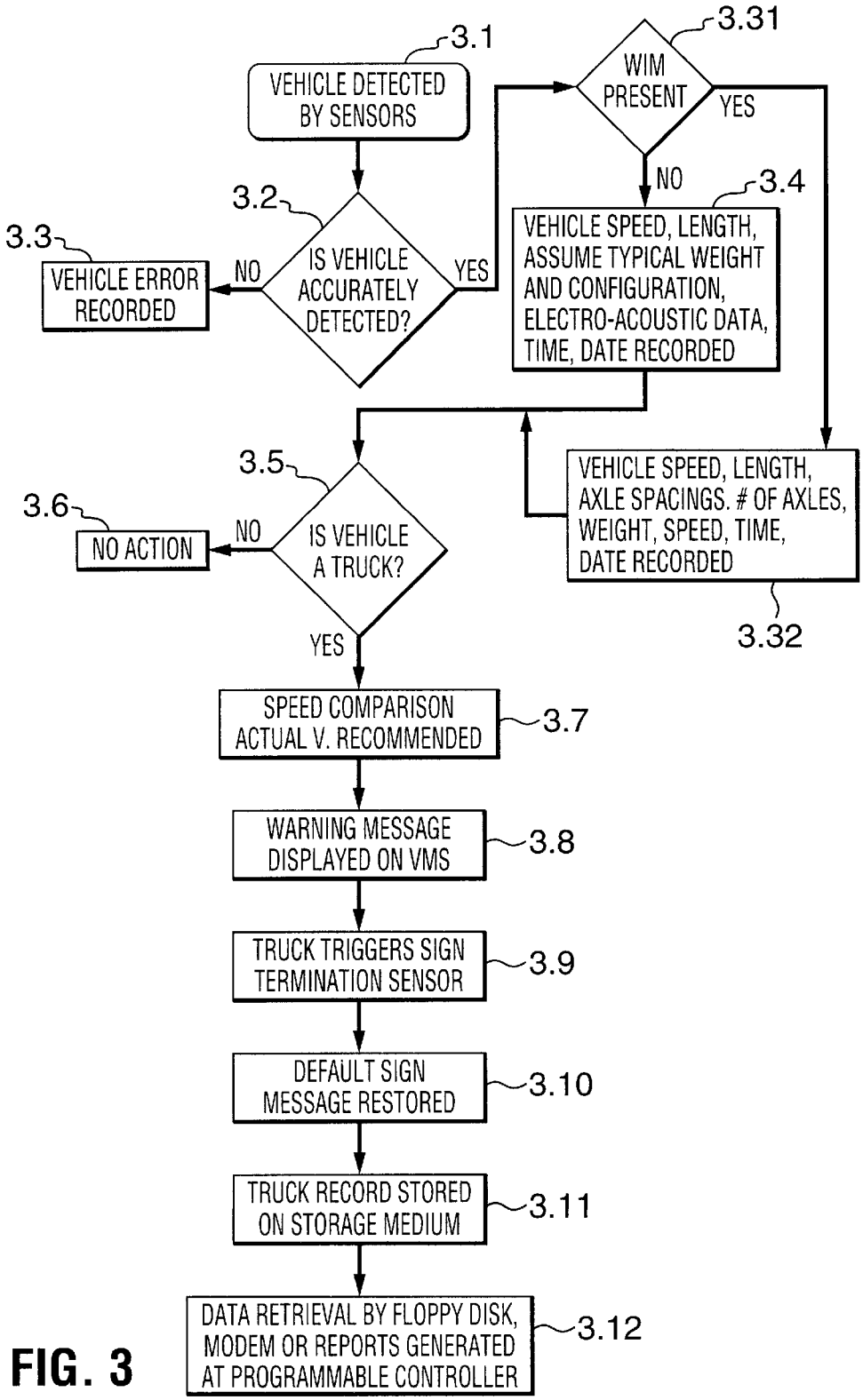
Figure 4:
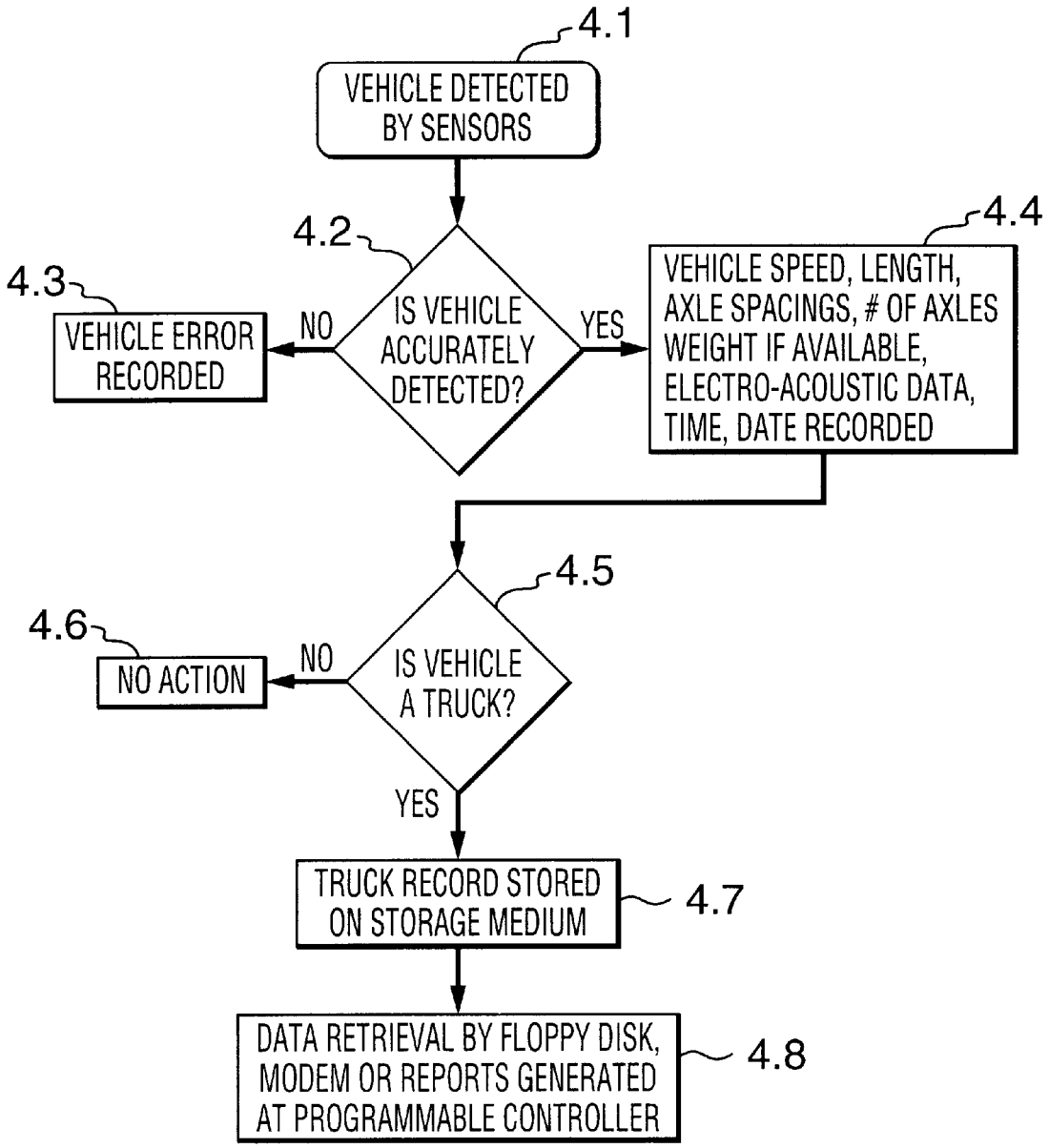
Figure 5:
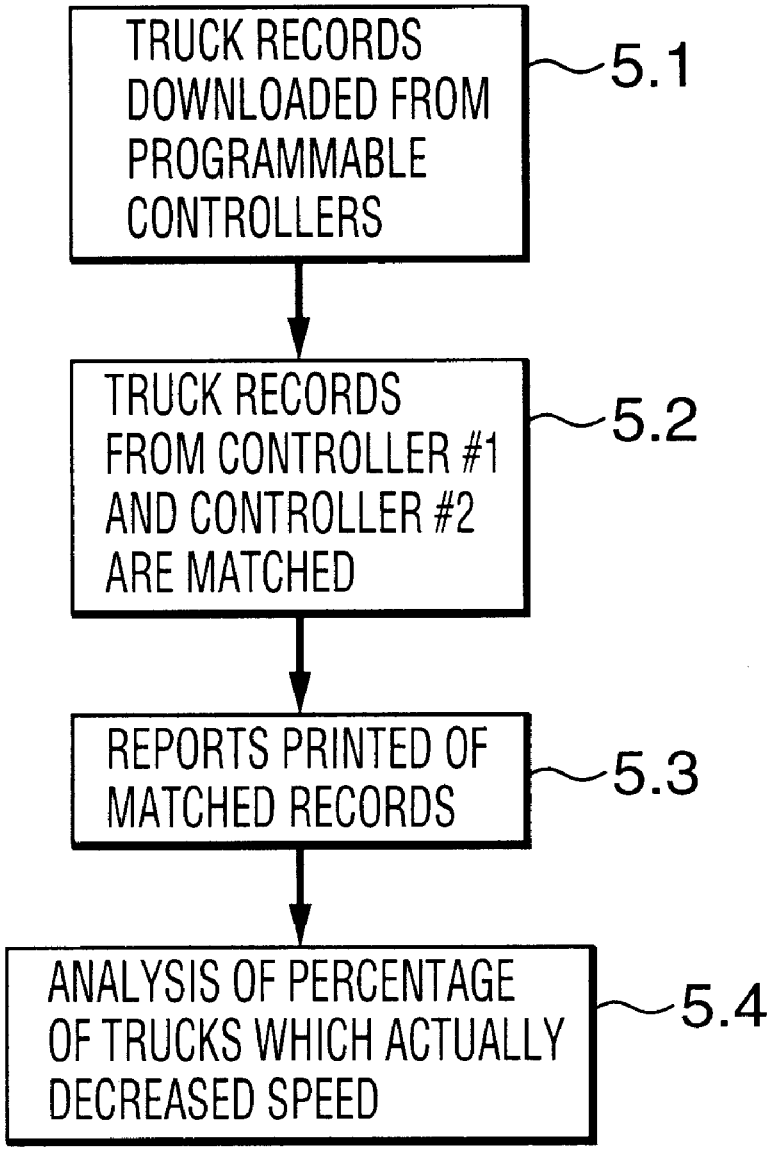
Figure 6:
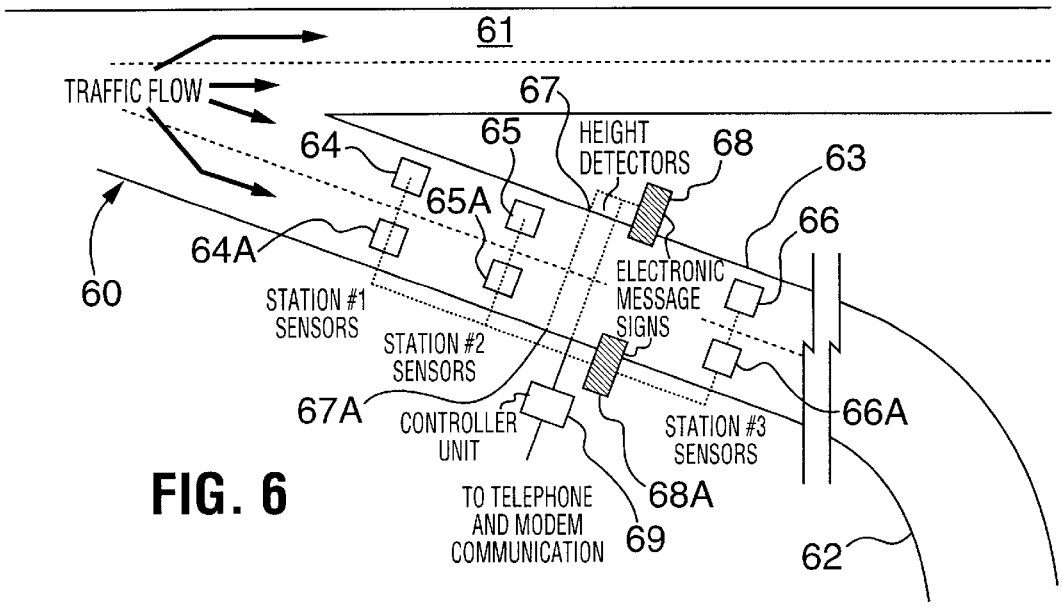
Figure 7:
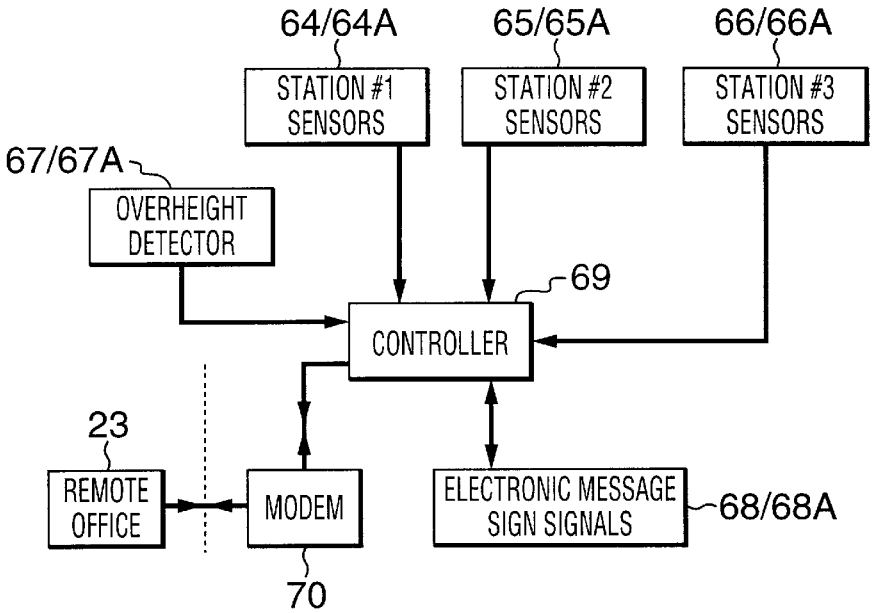
Figure 8A:
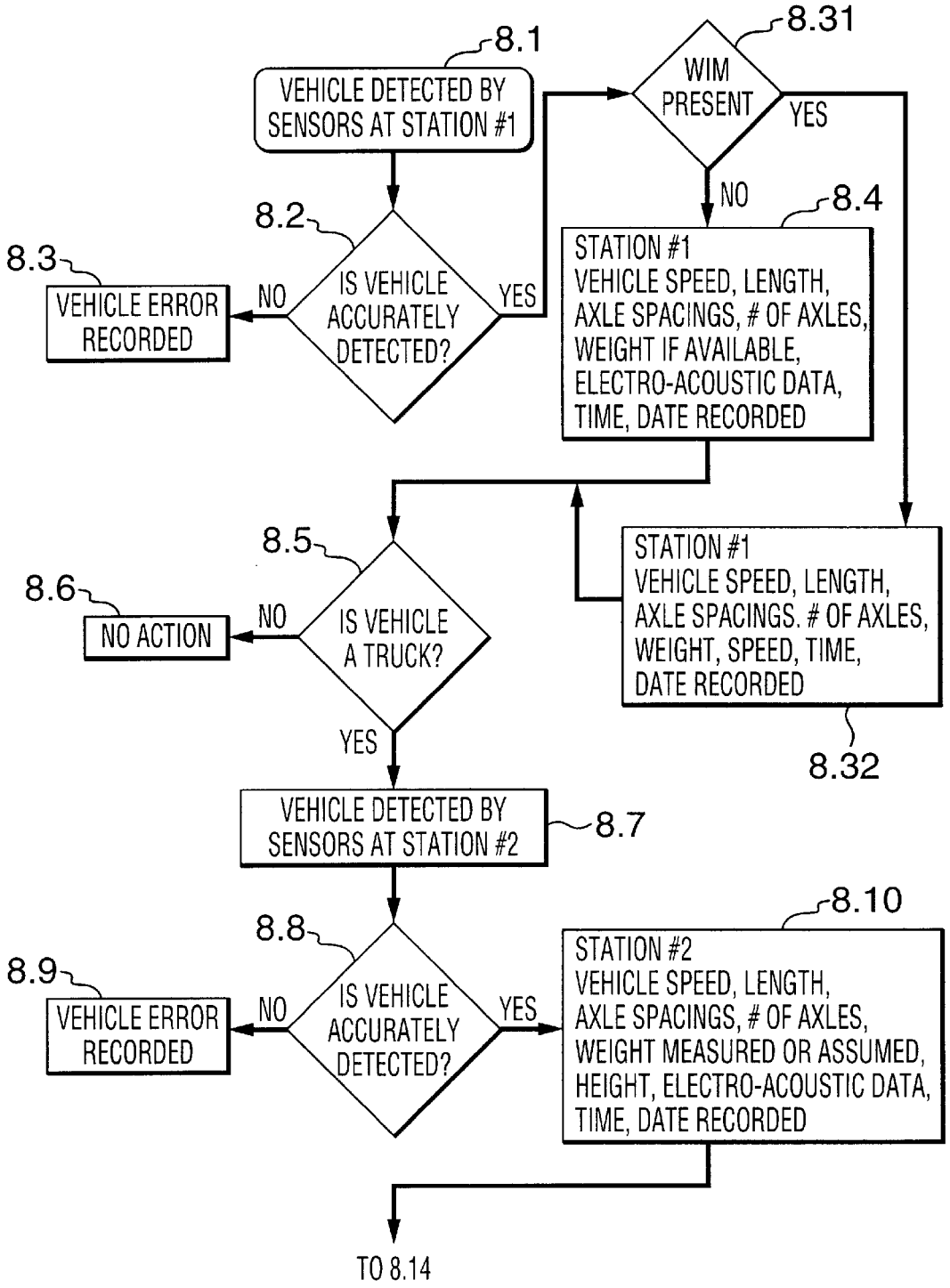
Figure 8B:
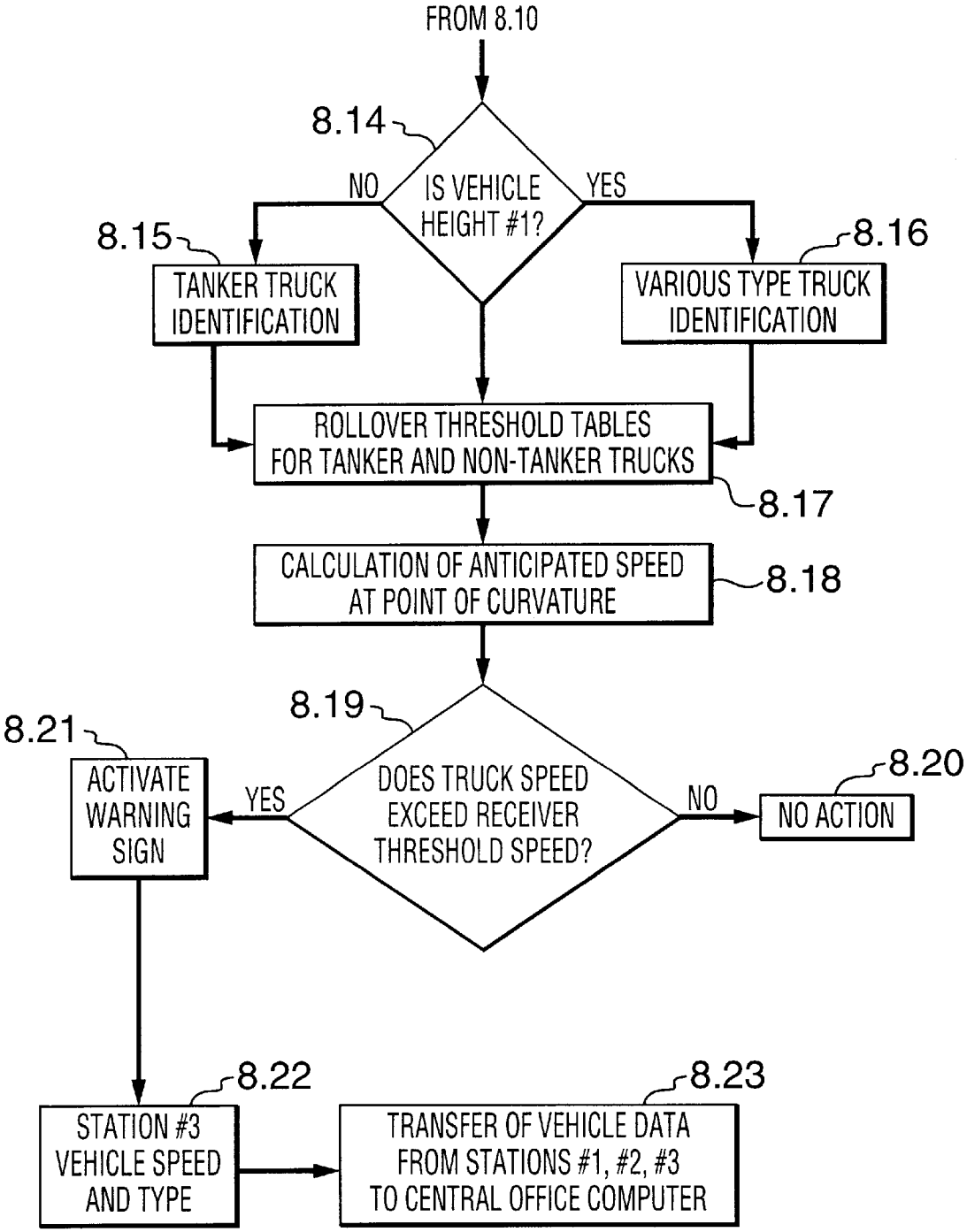
Figure 9:
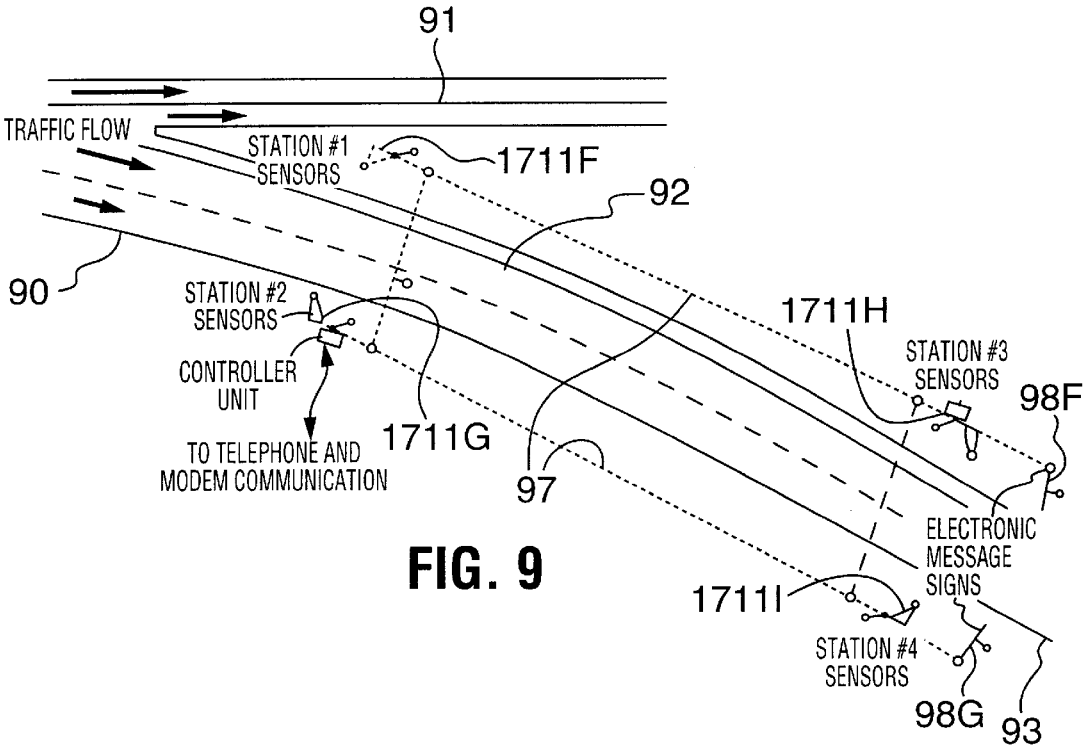
Figure 10:
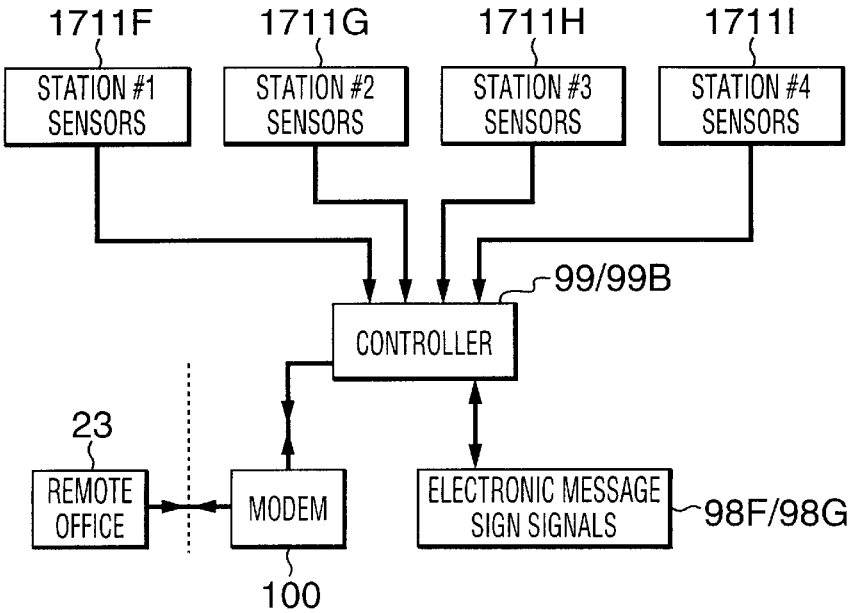
Figure 11A:
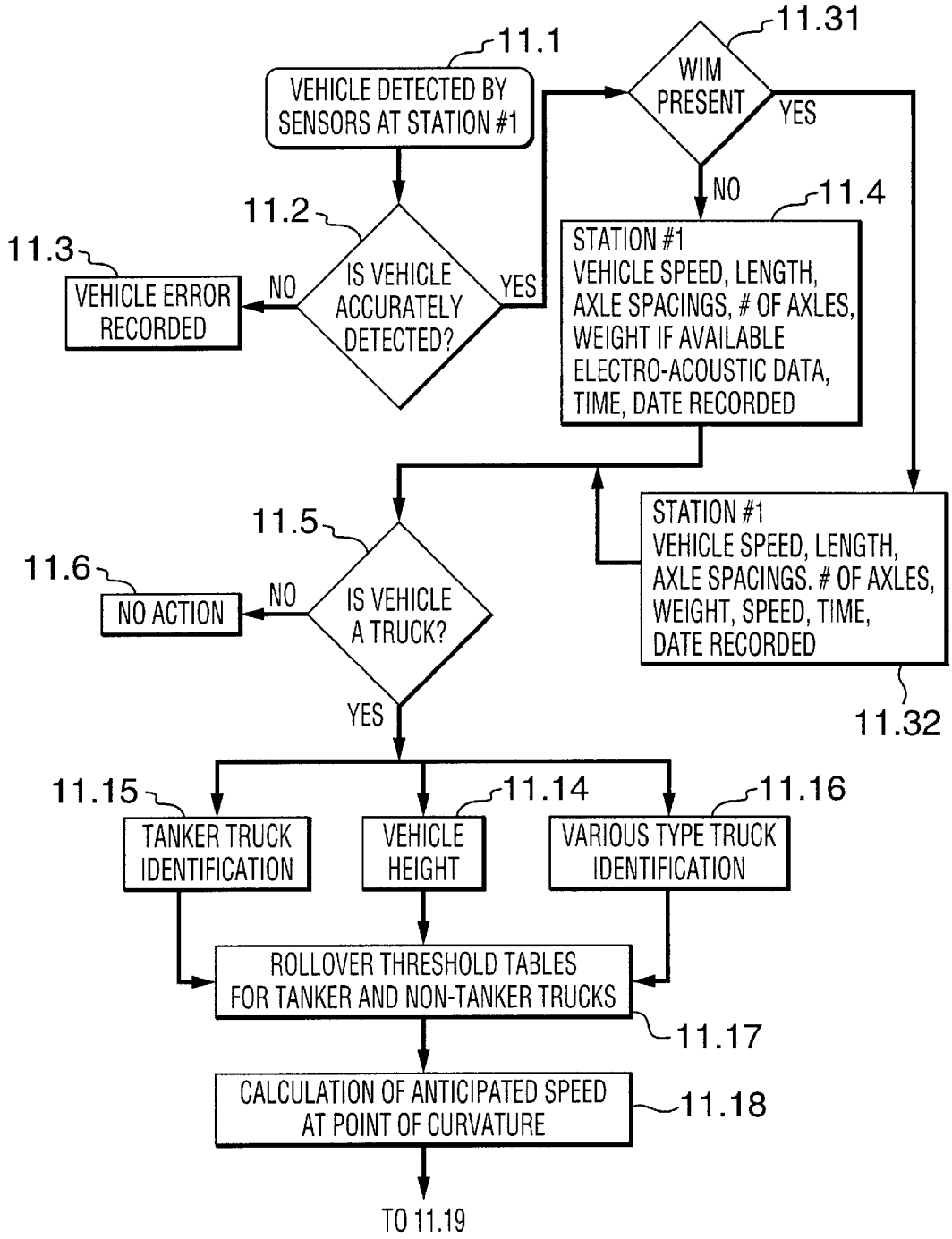
Figure 11B:
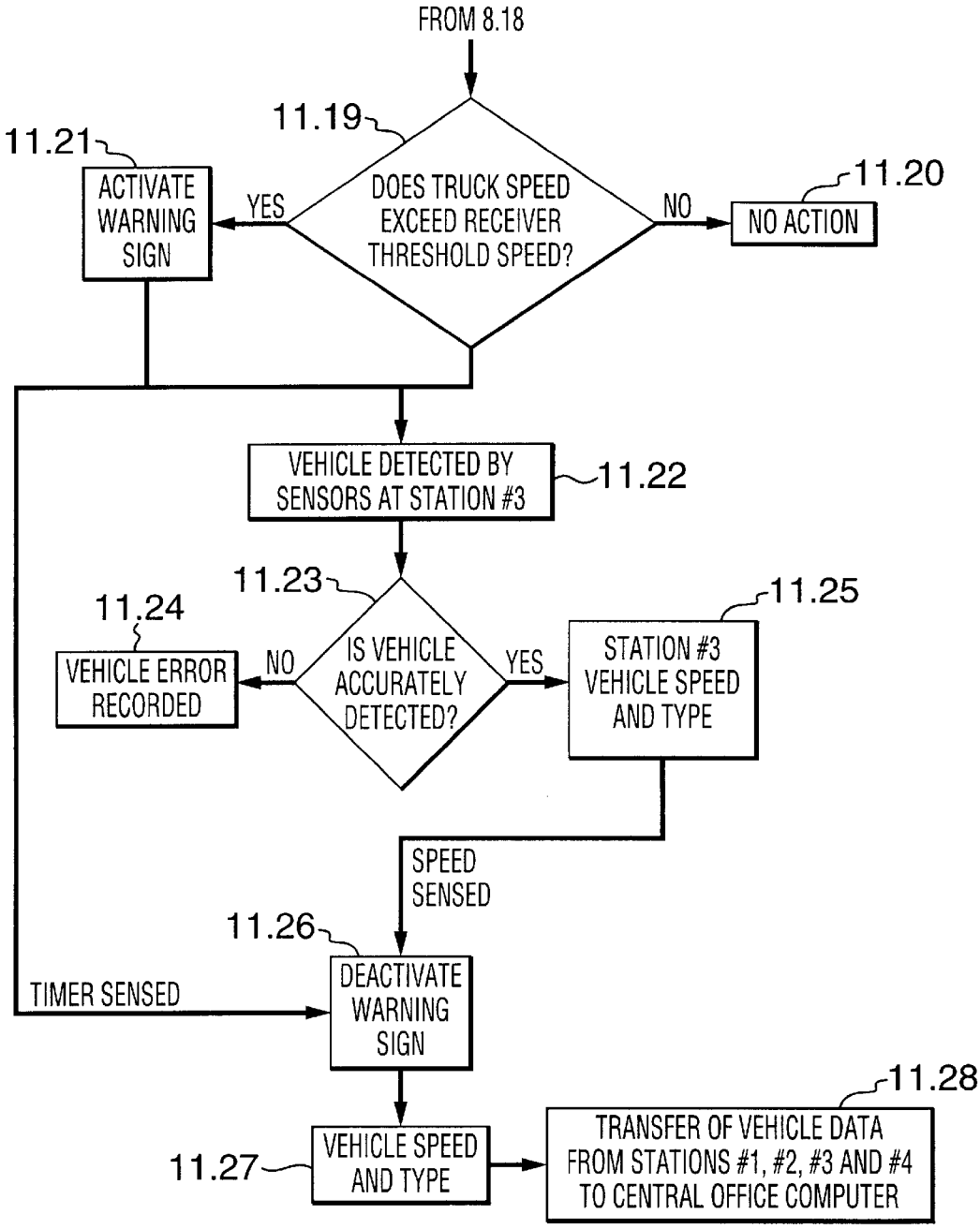
Figure 12:
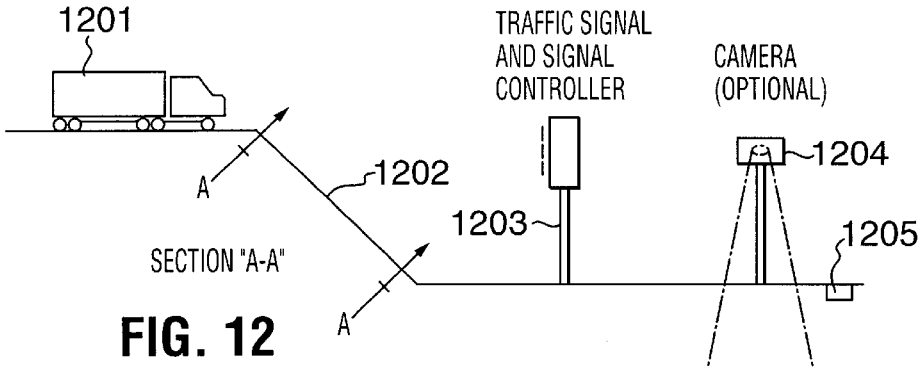
Figure 13:
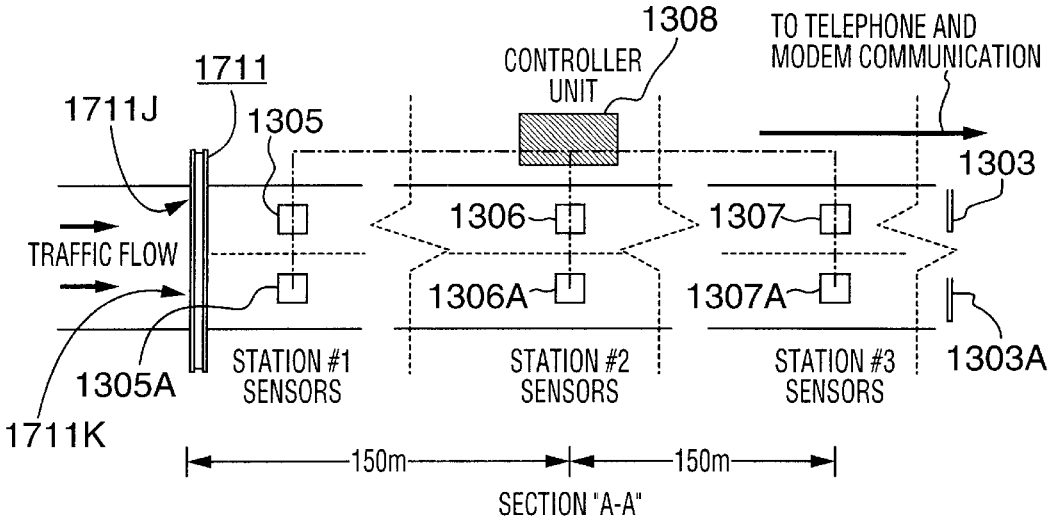
Figure 14:
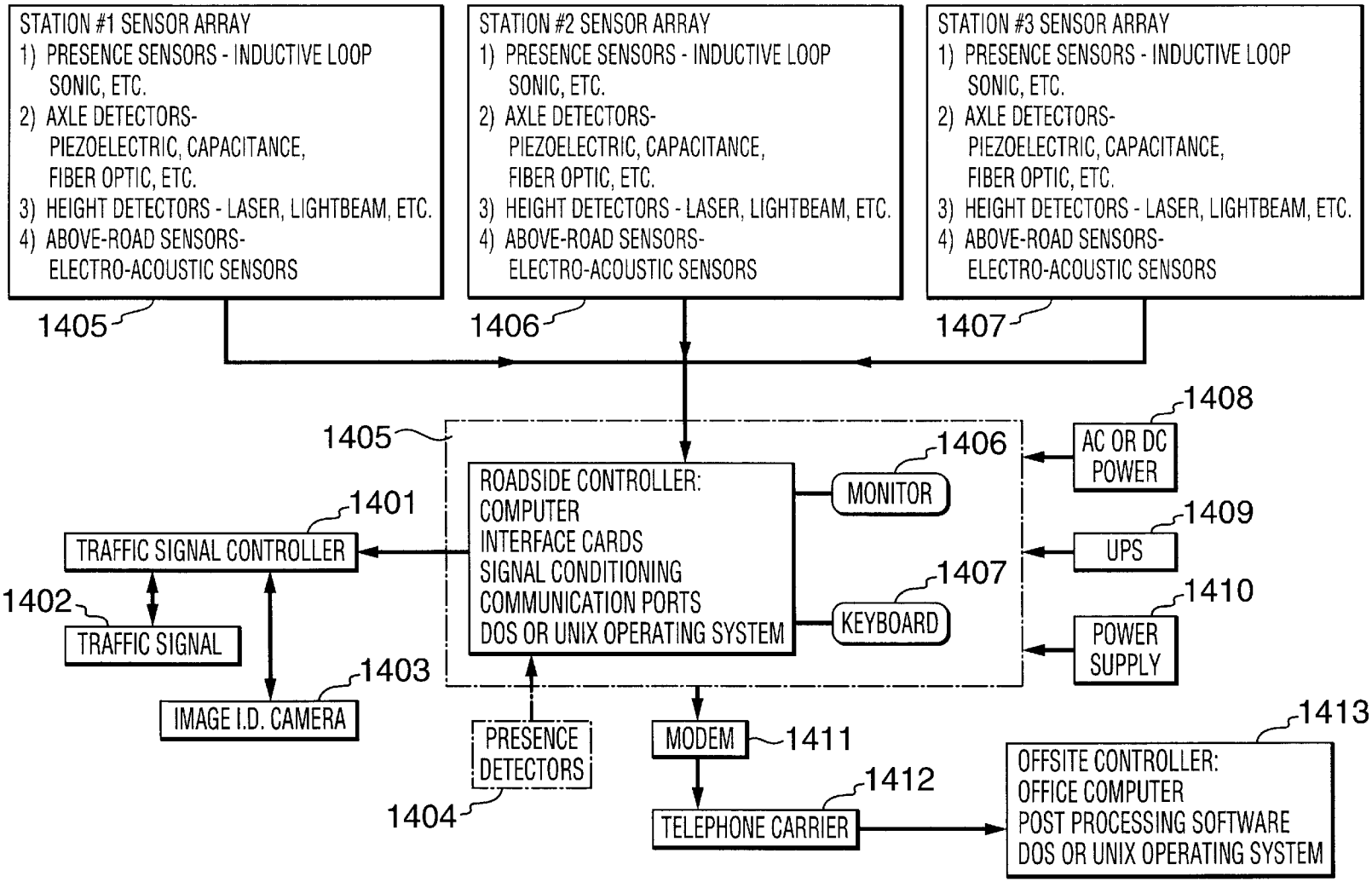
Figure 15A:
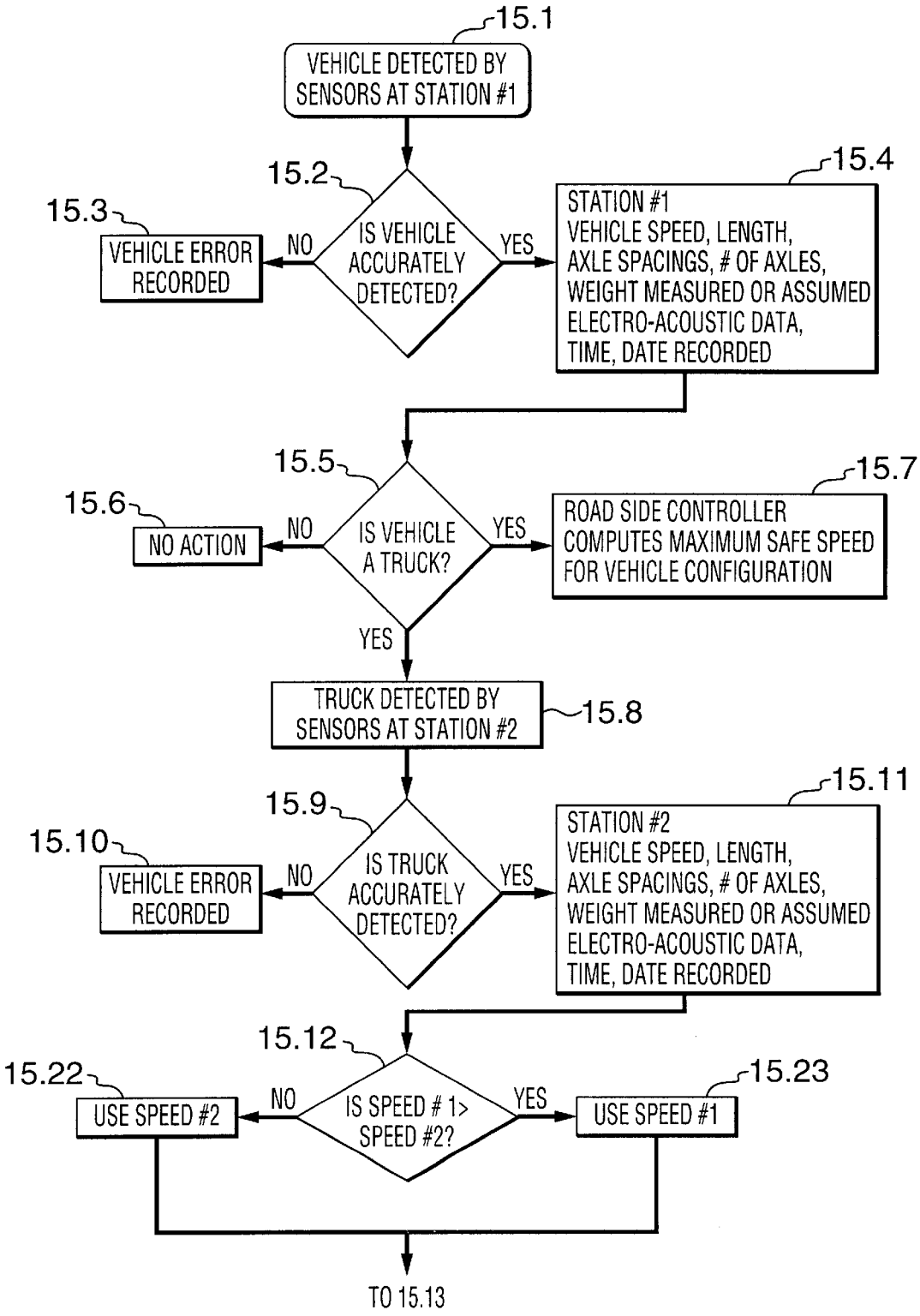
Figure 15B:
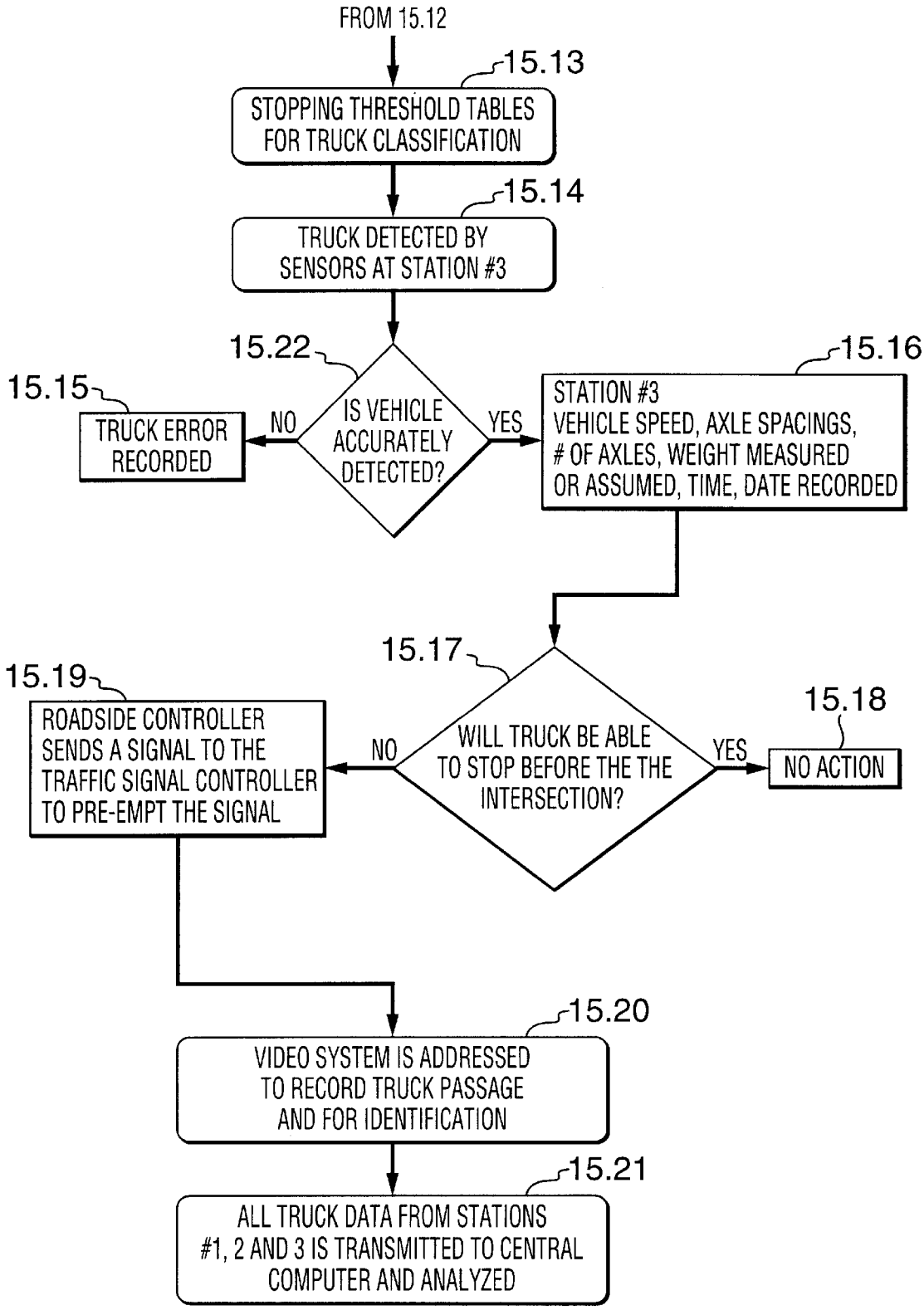
Figure 16:
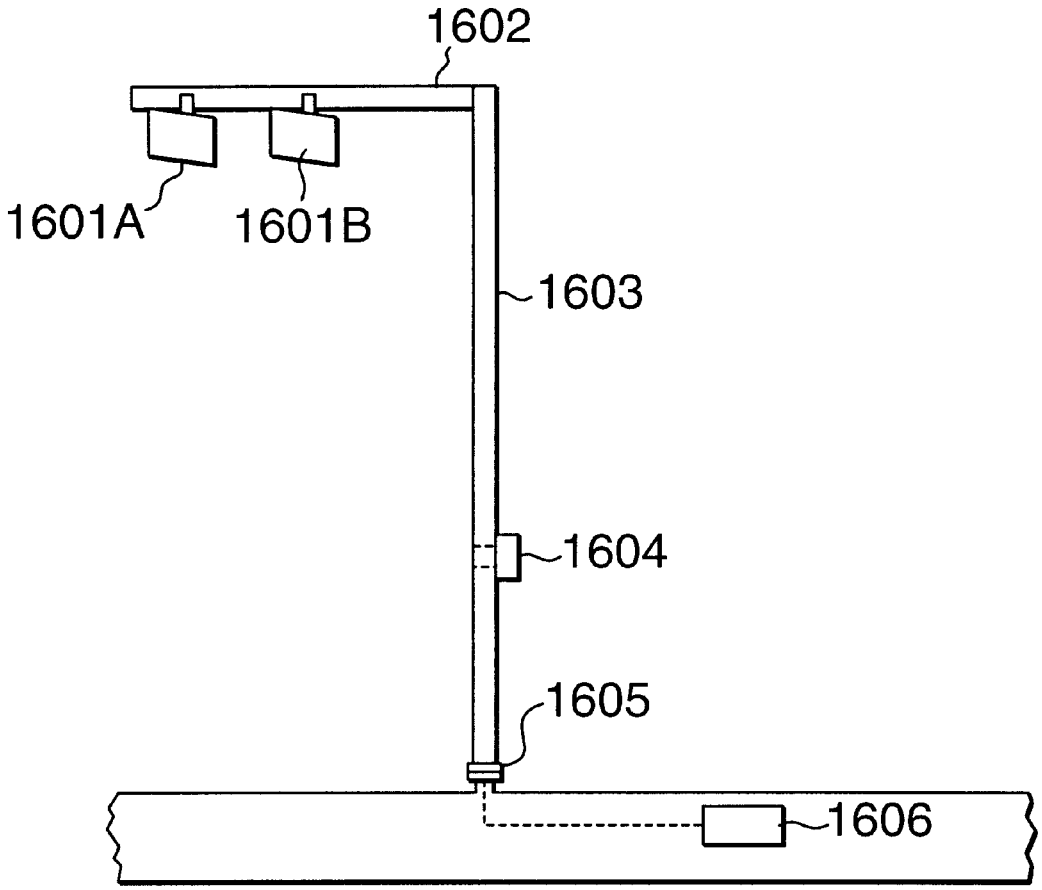
Figure 17:
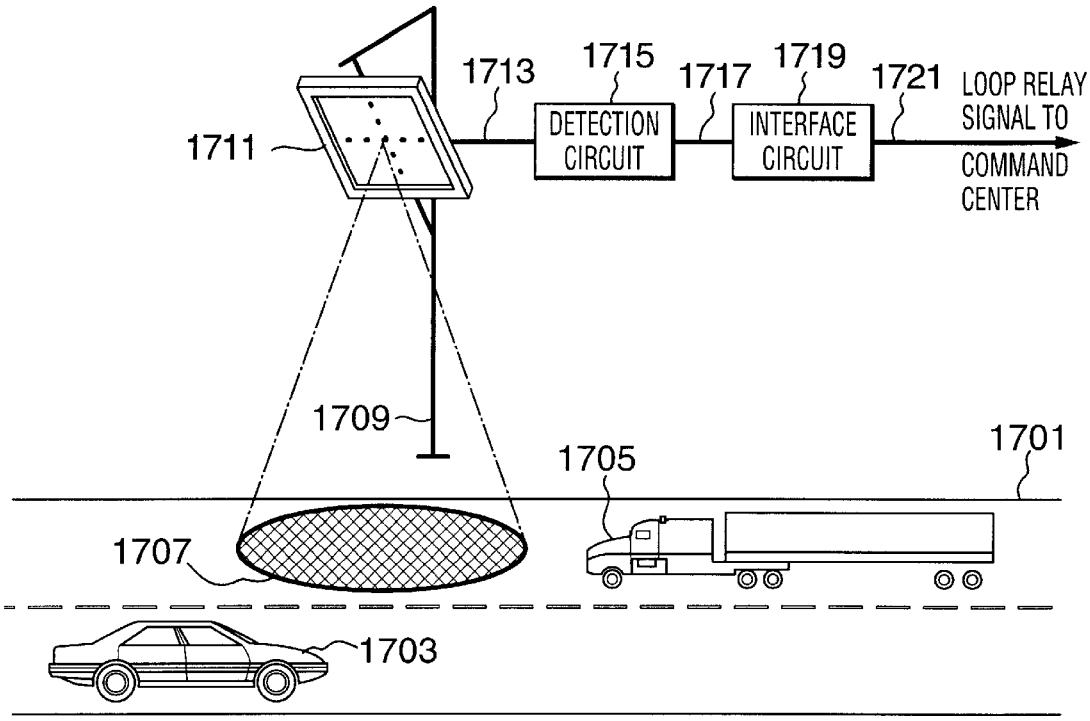
Figure 18:
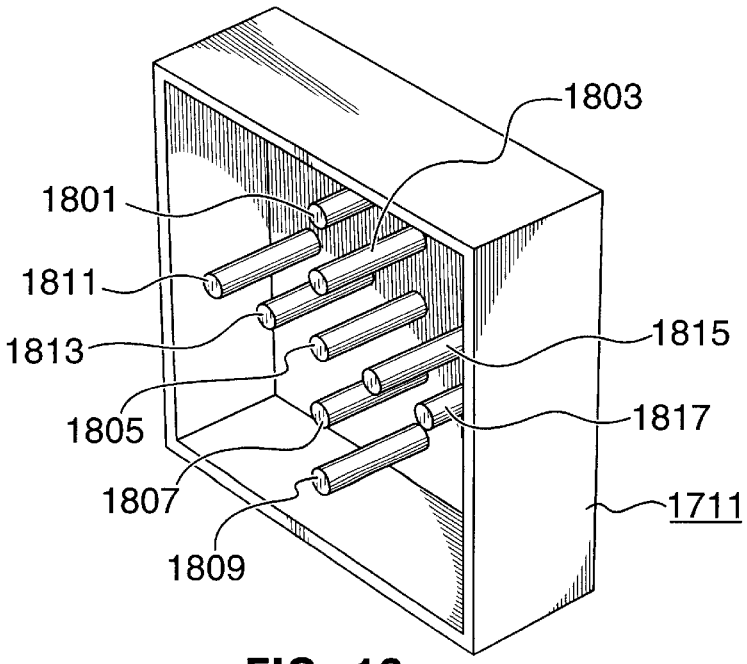
Figure 19:
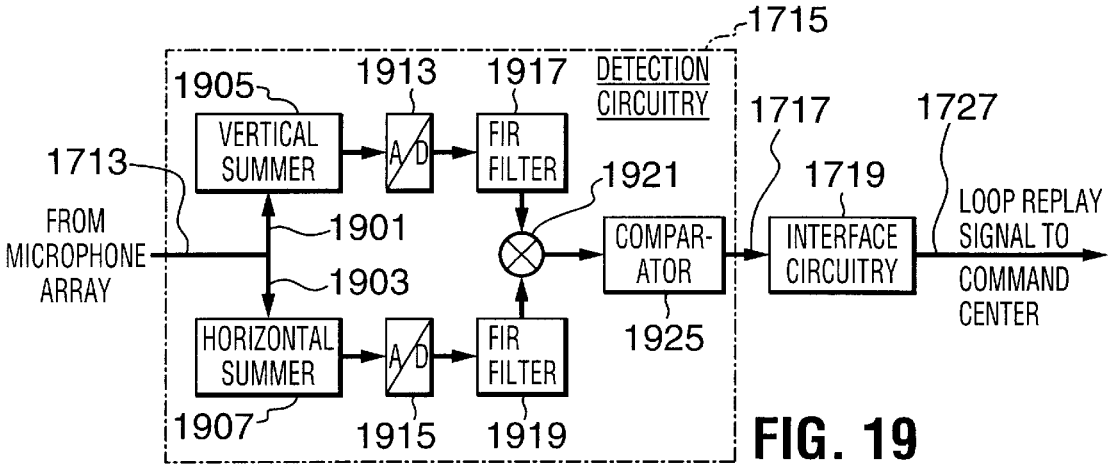
Figure 21:
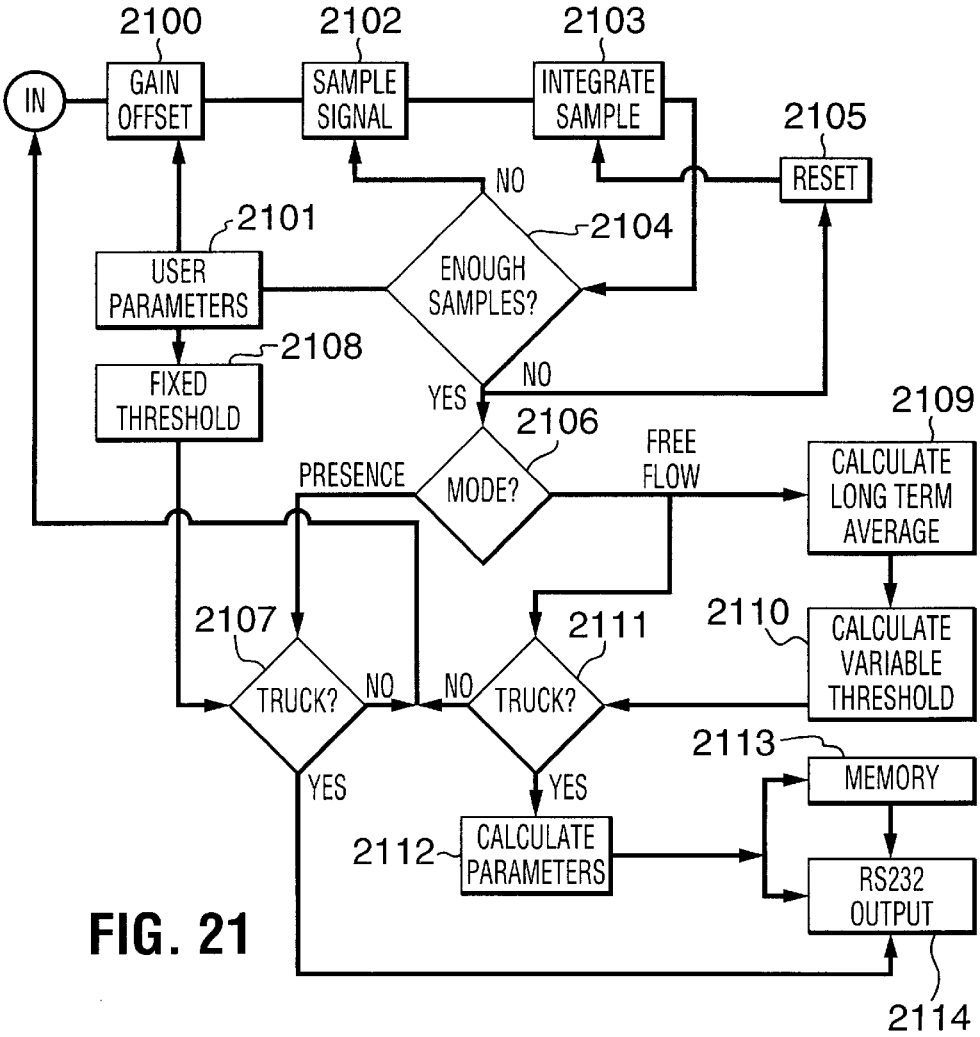
Figure 20:
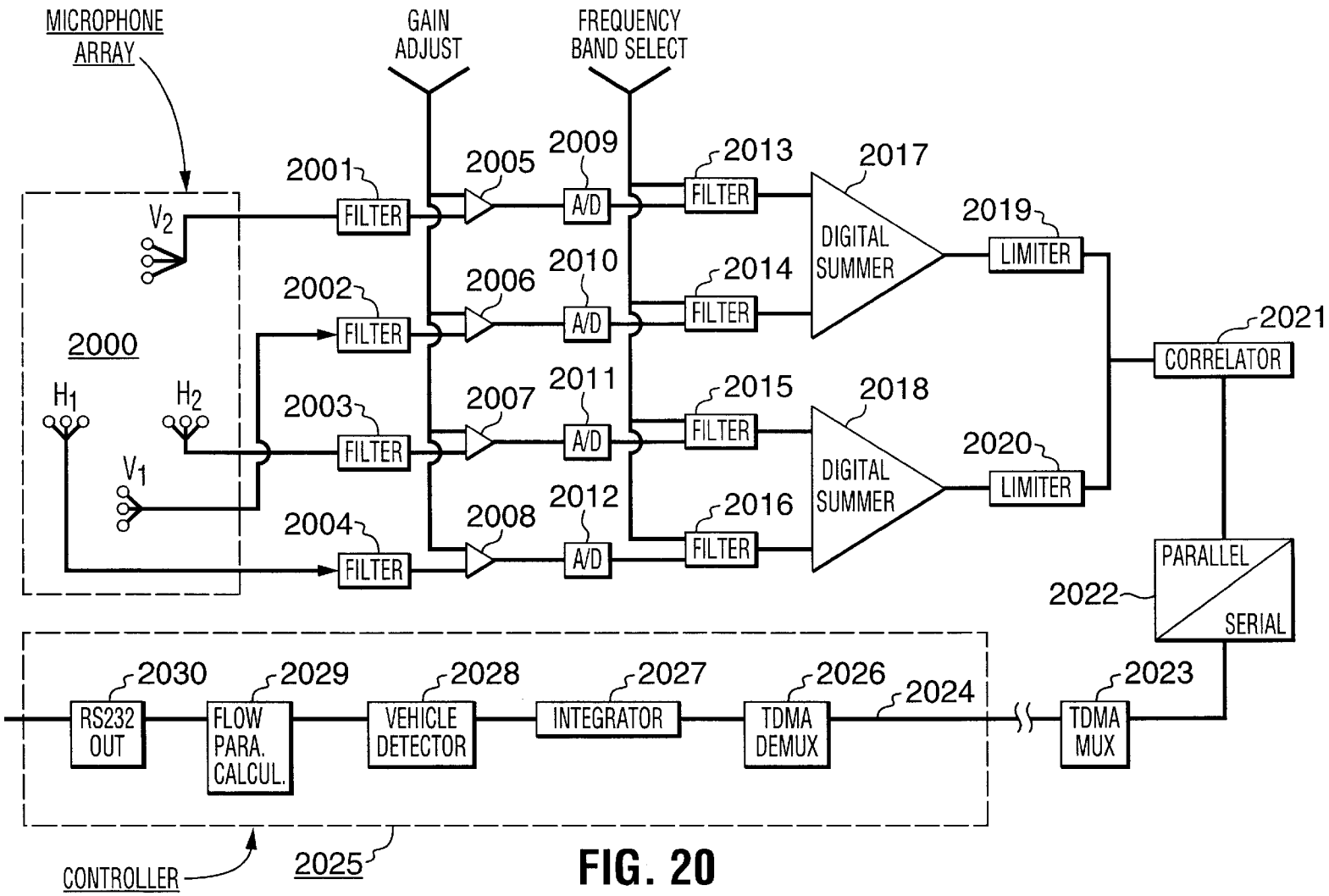

In the accompanying drawings:

FIG. 1 illustrates an embodiment of this invention comprising a traffic monitoring system which is installed upstream of a hazard for advising a driver of a detected truck of a safe speed for that truck to negotiate such hazard;

FIG. 2 is a block schematic diagram of the system of FIG. 1;

FIG. 3 is a flowchart depicting the operation of a first processor unit of the system of FIG. 2;

FIG. 4 is a flowchart depicting the operation of a second processor unit of the system of FIG. 2;

FIG. 5 is a flowchart depicting the subsequent processing of vehicle records for an optional embodiment of the system of FIG. 3;

FIG. 6 illustrates an embodiment of a truck monitoring system which is installed upstream of a curve, for monitoring for potential rollover of trucks negotiating the curve;

FIG. 7 is a simplified block schematic diagram of the system of FIG. 6;

FIGS. 8A and 8B are flowcharts depicting the operation of the system of FIG. 6;

FIG. 9 illustrates another embodiment of this invention comprising a truck monitoring system which is installed upstream of a curve of an off-ramp as a vehicle ramp advisory system to help prevent rollover accidents and out-of-control vehicles on sharp curves of freeway off-ramps;

FIG. 10 is a simplified block schematic diagram of the system of FIG. 9;

FIGS. 11A and 11B are flowcharts depicting the operation of the system of FIG. 8;

FIGS. 12 and 13 illustrate still another embodiment of this invention in the form of a traffic monitoring system which is installed upstream of a traffic-signal-controlled intersection and operable to pre-empt the traffic signals;

FIG. 14 is a simplified block schematic diagram of the system of FIGS. 12 and 13;

FIGS. 15A and 15B are flowcharts depicting operation of the system of FIGS. 12 and 13;

FIG. 16 is a side elevational view of the mounting of electro-acoustic sensor array sensors forming essential elements of the systems of embodiments of the present invention;

FIG. 17 is a drawing of an illustrative embodiment of an above-road electro-acoustic sensor array constituting an essential element of the systems of aspects of the present invention for monitoring the presence or absence of a truck in a predetermined detection zone;

FIG. 18 is a drawing of an illustrative microphone array for use in embodiments of an above-road electro-acoustic sensor array sensor constituting an essential element of the systems of embodiments of aspects of the present invention;

FIG. 19 is a block diagram of the internals of an illustrative detection circuit as shown in FIG. 17;

FIG. 20 is a detailed block diagram of a preferred embodiment of the above-road electro-acoustic sensor array constituting an essential element of the systems according to embodiments of aspects of the present invention; and FIG. 21 is a flow chart showing the operation of the controller block shown in FIG. 20.

DESCRIPTION OF PREFERRED EMBODIMENTS OF THE INVENTION (A) Hazard Warning System A generic aspect of the invention will now be described with reference to FIGS. 1 through 5. This generic aspect comprises a warning system which is installed at the approach to a hazard, whether it be a curve, an incline, a blind intersection, a traffic-signal controlled intersection, etc.

(i) Description of FIG. 1 and FIG. 2

Referring to FIG. 1 and FIG. 2, the hazard warning system comprises, at a first sensor station, a first set of above-road electro-acoustic sensor arrays 1711, (namely, 1711A, 1711B) for detecting trucks by means of acoustic signals. The above-road electro-acoustic sensor arrays can determine whether the detected vehicle is a truck, or is not a truck, by an analysis of the sounds emanating from the detected vehicle. In addition, the truck may be classified dependent on its length, since the length of the vehicle can be determined by the length of time between the beginning of the detection of the vehicle and the ceasing of detection of the vehicle in its traversing through the detection zone of a known length. Finally, the speed of the vehicle can be determined by the length of time for the vehicle to enter the detection zones of the above-road electro-acoustic sensor arrays. The hazard warning system may alternatively include a first pair of in-road sensors 12, 13 which may be of the type which are embedded in a roadway surface in the left-hand and right-hand traffic lanes, respectively. The in-road sensors 12,13 comprise vehicle presence detectors, and direct axle sensors which may comprise piezo-electric Class 1 sensors, or inductive loop presence detectors. Each of these in-road sensors 12, 13 may also be used to determine the speed of the detected vehicle by the length of time for the detected vehicle to traverse the detection zone of a known length. While such in-road sensors may be used, suitable alternative sensors and detectors could be used, e.g., those disclosed in the patents cited in the introduction of this specification.

On-scale detectors (not shown) may be incorporated in each lane adjacent to each of the in-road sensors 12,13. The on-scale detectors ensure that the trucks passing over the in-road sensors 12,13 are fully within the active sensor zone of the in-road sensors 12, 13, and are not straddling a lane. The on-scale detectors effectively eliminate the possibility that a truck which was improperly classified will receive a message recommending a speed that is higher than is safe for that particular truck.

The above-road electro-acoustic sensor arrays 1711 also assure that errors which may incur by a truck straddling a lane do not affect the safe speed calculation. Therefore, such above-road electro-acoustic sensor arrays are important features of the warning system of embodiments of the present invention.

A short distance downstream from the above-road electro-acoustic sensor arrays 1711A, 1711B, or the in-road sensors 12, 13, two traffic signal devices, in the form of electronic, variable message signs 14,15, are positioned adjacent to respective left-hand and right-hand traffic lanes. The above-road electro-acoustic sensor arrays 1711A, 1711B, or the in-road sensors 12,13 and the electronic message signs 14,15 are connected to a first programmable roadside controller 16, which is conveniently located nearby. The programmable roadside controller 16 comprises a microcomputer which is equipped with interfaces for conditioning signals from the above-road electro-acoustic arrays 1711A, 1711B, or from the in-road sensors 12, 13, and an interface for transmitting a control signal to the respective message sign 14, 15 for the lane in which the vehicle is travelling. The microcomputer is preprogrammed with hazard site-specific software and data, i.e., specifically related to the location of the above-road electro-acoustic sensor arrays 1711A,1711B, or the in-road sensors 12, 13, and the specific characteristics of the hazard, and truck classification data, which may be based, e.g., on the length of the truck. It processes the signals from the above-road electro-acoustic sensor arrays 1711A, 1711B, or the in-road sensors 12,13, and determines, for each truck, information including, but not limited to, number of axles on the truck, distance between axles, bumper-to-bumper vehicle length, vehicle speed, truck class, which is based upon the number of axles and their spacings, and lane of travel of the truck. Using the hazard site-specific information and the truck classification information, the microcomputer computes an appropriate safe speed based on, inter alia, the class of the truck, and transmits a corresponding signal to the appropriate message sign 14, 15, causing it to display the safe speed while the truck passes through the region in which the sign can be viewed by the driver of the truck. The duration of the message is based upon hazard site-specific geometries and varies from site to site.

The microcomputer creates a truck record and stores it in memory, with the recommended safe speed, for subsequent analysis.

If the system cannot classify the truck accurately, e.g., when a truck misses some of the above-road electro-acoustic sensor arrays, or the in-road sensors by changing lanes, the system will not display a recommended speed. In such case, the variable message sign will display a default message, e.g., "DRIVE SAFELY". The default message is user-programmable, allowing alternative messages to be substituted.

Downstream from the electronic message signs 14,15 is a second set of above-road electro-acoustic sensor arrays 1711,(namely, 1711C, 1711D,) or in-road sensors (namely, 17,18,) which are the same as the first set of above-road electro-acoustic sensor arrays 1711 (namely, 1711A, 1711B) and in-road sensors (namely, 12,13), and so need not be describe further.

These second set of above-road electro-acoustic sensor arrays 1711(namely, 1711C, 1711D), or in-road sensors (namely, 17,18), are provided in conjunction with respective lanes of the roadway about one kilometer (about 0.6 mile) beyond the variable message signs 14,15. These second set of above-road electro-acoustic sensor arrays 1711 (namely, 1711C,1711D), or in-road sensors (namely, 17,18), are coupled to a secondary roadside controller 19 to form a secondary sub-system. This secondary sub-system collects the same information as the primary sub-system, but it is used only for monitoring the effectiveness of the primary system.

(ii) Description of FIG. 2

As seen in FIG 2, the roadside controllers 16 and 19 are equipped with modems 20, 21, respectively, enabling remote retrieval of their truck record data, via a telephone system, by a central computer 23 in a central operations building (not seen). Programmable controller 16 includes an AC or DC power line 16A, which is connected to an UPS 16B and to a power source 16C. Programmable controller 16 also includes a monitor 16D and a keyboard 16E. Likewise, programmable controller 19 includes an AC or DC power line 19A, which is connected to an UPS 19B and to a power source 19C. Programmable controller 19 also includes a monitor 19D and a keyboard 19E. Each controller 16, 19 may also have an interface or communications port enabling the truck records to be retrieved by, for example, a laptop computer. The system may also allow system operators to have full control over the primary sub-system of above-road electro-acoustic sensor arrays 1711 (namely, 1711A, 1711B), or in-road sensors (namely, 12, 13), including a disabling function and the ability to change the message on the variable message signs. The remote computer also has data analysis software providing the ability to take two data files (one from the primary sub-system and another from the secondary sub-system) and to perform an analysis on the compliance of the truck operator to the variable sign messages. Specific truck records from the two subsystems can be matched, and reports can be generated on the effectiveness of the speed warning system.

(iii) Description of FIG. 3, FIG. 4 and FIG. 5

The sequence of operations as a vehicle (namely, a truck), is processed by one embodiment of a system which is depicted in the flowcharts shown in FIG. 3 and FIG. 4, and subsequent analysis in the flowchart of FIG. 5. For convenience of description, it will be assumed that the vehicle is in the left-hand lane. It will be appreciated, however, that the same process would apply to a vehicle in the other lane. Referring first to FIG. 3, which depicts operation of the primary roadside controller 16, when a vehicle passes under above-road electro-acoustic sensor arrays 1711A, or over in-road sensors 12, the microcomputer receives a vehicle detection signal, step 3.1, and confirms, in decision step 3.2, whether or not the vehicle has been detected accurately. If it has not, step 3.3 records an error. If the vehicle has been detected accurately, it is assumed to be a truck and if no weigh-in-motion (WIM) scale is present, a typical weight and configuration of the truck is assumed. The microcomputer creates a truck record containing this information, namely, electro-acoustic data and axle spacings and number of axles and length together with the time and date at step 3.4. If a weigh-in-motion (WIM) scale is present at 3.31, the actual weight, as well as other information, namely, electro-acoustic data and axle spacings and number of axles, and length, together with the time and date is recorded at step 3.32. Comparing the information with truck classifications which are stored in its memory, the microcomputer determines, in step 3.5, whether or not the vehicle is a truck. If it is not, no further action is taken, as indicated by step 3.6. If it is a truck, step 3.7 conducts a speed comparison of the actual speed with a nominal recommended speed, and accesses a truck class specific speed table to determine, for that truck class, a recommended safe speed for that truck safely to negotiate the hazard. In step 3.8, the microcomputer conveys a corresponding signal to variable message sign 14 which displays a "WARNING" message. The truck driver is expected to gear down and to take due action as regard to nature of the hazard. Once the truck passes the variable message sign 14, steps 3.9 and 3.10 restore the variable message sign to the default message. The default restoration signal may be generated when the truck triggers a subsequent termination sensor, e.g., the second set of above-road electro-acoustic sensor arrays 1711C, 1711D, or the second set of on-road sensors, 17, 18, or a timer "times-out" after a suitable time-out interval. Step 3.11 stores the truck record, including the recommended speed, in memory for subsequent retrieval, as indicated by step 3.12, using a floppy disc, via modem, a laptop or any other suitable means of transferring the data to the central computer for subsequent analysis.

After passing through part of the distance to the hazard, the truck passes the region of the second set of above-road electro-acoustic sensor arrays, (namely, 1711C and 1711D), or the in-road sensors (namely, 17,18), for one purpose, as specified above, of generating a default restoration signal and to enable the secondary roadside controller 19 to receive a vehicle presence signal, as indicated in step 4.1 in FIG. 4. The secondary programmable roadside controller performs an abridged set of the operations which were carried out by the primary roadside controller 16. Thus, following receipt of the vehicle presence signal in step 4.1, it determines in step 4.2 whether or not the truck was accurately detected. If it was not, step 4.3 records an error. If it was, in step 4.4, the signals from the above-road electro-acoustic sensor arrays 1711C and 1711D, or from the in-road sensors 17,18, are processed to produce a secondary truck classification record, e.g., electro-acoustic data, axle spacings, number of axles, weight, (if available), length, and speed, together with the time and date. Using this information, and truck classification data which are stored in memory, step 4.5 determines whether or not the vehicle is a truck. If it is not, no further action is taken, as indicated by step 4.6. If it is a truck, step 4.7 stores the vehicle record in memory. As in the case of the primary controller 16, the truck records can be downloaded to a floppy disc, via modem, a laptop or any other suitable means of transferring the data to the central computer for subsequent analysis to determine the effectiveness of the system.

(iv) Description of FIG. 5

FIG. 5 shows an optional flowchart for the analysis by the central computer, but only if a weigh-in-motion (WIM) scale is present. If such weigh-in-motion scale (WIM) is present, truck records are downloaded in step 5.1 from both programmable controllers 16 and 19 and are compared in step 5.2 to match each primary truck record from the primary controller 16 with a corresponding secondary truck record, i.e., for the same truck, from the secondary controller 19. The comparison is based on time, number of axles, axle spacings and length of truck. A matched set of records, as in step 5.3, enables a comparison to be made between the speed of the truck when it traversed under the first set of above-road electro-acoustic sensor arrays 1711A, or over the in-road sensors 12, and its speed when it traversed under the second set of above-road electro-acoustic sensor arrays 1711C, or over the in-road sensor 17. Step 5.4 determines the percentage of trucks which decreased speed as advised.

The generic hazard truck speed warning system as described above, is not intended to replace runaway truck ramps, but to complement the ramps and potentially decrease the probability of required use of these ramps.

(B) Rollover Warning System (i) Description of FIG. 6

FIG. 6 shows the components of a traffic monitoring system, i.e., a rollover warning system, for detecting potential rollover of a truck approaching a curve, which is deployed between an exit 60 of a highway 61 and a curved ramp 62 of the exit road 63. The system comprises first set of in-road sensors 64, 65, namely station # 1 in-road sensors 64, and station # 2 in-road sensors 65, which are spaced apart along the left hand lane of the exit road upstream of the curve 62. In-road sensors 64, 65, which comprise vehicle presence detectors and axle sensors, are similar to those used in the first embodiment which was described in FIGS. 1 to 5. A height detector 67, is positioned alongside the left hand lane. The height detector 67 may comprise any suitable measuring device, e.g., a laser or other light beam measuring device. A traffic signal device, in the form of an electronic message sign 68, is disposed downstream from the in-road sensors 64, 65, and is associated with the left hand traffic lane, for example above it or adjacent to it. The exit road has two lanes and a duplicate set of in-road sensors 64A, 65A, 66A, a height detector 67A and a traffic signal device 68A are provided for the right hand lane. Since the operation is the same for both sets of in-road sensors, only the set in the left hand lane will be described further.

(ii) Description of FIG. 7

Referring now to FIG. 7, the station #1 in-road sensors 64, the station # 2 in-road sensors 65, the station # 3 in-road sensors 66, the overheight detector 67, and the electronic message sign 68, are connected to a roadside controller 60 which comprises the same basic components as the roadside controller of the aspect embodiment described in FIG. 1 to FIG. 5 above, including a microcomputer and a modem 70. The microcomputer contains software and data for processing the sensor signals to give vehicle class based on vehicle length, number of axles and axle spacings, and vehicle speed. The microcomputer is preprogrammed, upon installation, with data which is specific to the site, e.g., camber and radius of the curve, and the various distances between the in-road sensors and the curve. In use, the processor uses the site-specific data, and the truck-specific data which are derived from the in-road sensors 64, 65, 66, and height detector 67, to compute deceleration between the in-road sensors and to predict the speed at which the truck will be travelling when it arrives at the curve 62. Taking into account height and class of the truck, and camber and radius of the curve, it determines a maximum safe threshold speed at which that particular class of truck should attempt to negotiate the curve. If the predicted speed exceeds this maximum, implying a risk of rollover occurring, the processor activates the message sign to display a warning, e.g., "SLOW DOWN!" or some other suitable message. The sign is directional and is viewed only by the driver of the passing truck. The threshold speed is programmable and can be inputted or changed by the system user.

(iii) Description of FIGS. 8A and 8B

The sequence of operations as a vehicle is processed by the system will now be described with reference to FIG. 8A and FIG. 8B. When the vehicle passes over in-road sensors 64, 65, the resulting presence detection signal from the presence detector at sensor arrays 64, 65 is received by the processor in step 8.1 and the processor determines, in step 8.2, whether or not a vehicle has been accurately detected as a truck. If it has not, step 8.3 records an error. If the vehicle has been detected accurately, and if no weigh-in-motion (WIM) scale is present, a typical weight and configuration of the truck is assumed. The microcomputer creates a truck record containing this information, namely, axle spacings and number of axles, and length, together with the time and date at step 8.4. On the other hand, if a weigh-in-motion (WIM) scale is present at 8.31, the actual weight, as well as other information, namely, axle spacings and number of axles, and length, together with the time and date is recorded at step 8.32. The micro computer uses this information, together with the time and date, to create a vehicle record. In decision step 8.5, from the information at steps 8.4 or 8,32, the micro computer compares the measurements with a table of vehicle classes to determine whether or not the vehicle is of a class listed, specifically one of various classes of truck. If it is not, the processor takes no further action as indicated in step 8.6. If decision step 8.5 determines that the vehicle is a truck, however, the processor determines in steps 8.7 and 8.8 whether or not the truck was also accurately detected at sensor array 65. If not, an error is recorded in step 8.9. If it is detected accurately, the processor processes the signals received from sensor 65 to compute, in step 8.10 the corresponding measurements as in step 8.4.

Station #2 may not be present in all systems, and, in such case, the system would then proceed from step 8.5 directly to step 8.14.

In step 8.14, the processor determines whether or not vehicle height is greater than a threshold value (e.g., about eleven feet). If the vehicle height is greater than the threshold value, the processor proceeds to step 8.15 to identify it as a particular class of truck. If the height of the vehicle is less than the threshold value, step 8.16 identifies the truck type. Having identified the truck type in step 8.15 or step 8.16, the processor proceeds to access its stored rollover threshold tables in step 8.17 to determine a threshold speed for that particular truck safely to negotiate the curve. In step 8.18, the measured speed at station # 1 is the speed of the truck when it arrives at the beginning of the curve 62. Step 8.19 compares the predicted speed with the rollover threshold speed. If it is lower, no action is taken, as indicated by step 8.20. If the predicted speed is higher than the rollover threshold speed, however, step 8.21 activates the message sign 68 for the required period to warn the driver of the truck to slow down.

Step 8.22 represents the sequence of steps which are taken by the processor to process the corresponding signals from sensor array 66 to ascertain the speed of the truck and the type of truck, and to create a secondary record. Subsequent transmission of the truck data derived from all three in-road sensors 64, 65, 66 to a central computer, or retrieval in one of the various alternatives outlined above, is represented by step 8.23.

In-road sensor 66 is optional and is for system evaluation purposes. It is positioned between the electronic message sign 68 and the curve 62 and is used to monitor whether or not the message is heeded, i.e., whether or not trucks are slowing down when instructed to do so by the message sign. The signals from its sensors are also supplied to the programmable controller 69. This in-road sensor 66 need only supply information to enable truck speed to be determined and so comprises a truck axle sensor and a truck presence detector which is activated when a truck enters its field. The controller 69 processes the signals from in-road sensor 66 to produce a secondary truck record. As before, data from the controller 69 can be downloaded to a remote computer and truck records from the first in-road sensor and the second in-road sensor compared with the corresponding truck record from the third in-road sensor to determine the speed of the truck before and after the message sign. This allows statistics to be accumulated showing the number of trucks slowing down when instructed to do so by the message sign, thereby allowing evaluation of system effectiveness.

The system algorithm is site specific to accommodate certain site characteristics. The software can be compiled on any curve site with a known camber and radius. The data is stored on site in the programmable controller and is retrievable either by a laptop computer on site or remotely via modem communication. The controller also has an auto-calibration feature. If the system fails for any reason, an "alert" signal is transmitted to the host computer via modem, informing the system operators of a system malfunction.

The programmable controller allows the system operator to adjust maximum allowable safe speeds, based on collected data on truck speeds at particular locations. For example, if the maximum safe speed is set at the posted speed limit, but if the majority of trucks are exceeding the posted speed limit at a particular location, then the variable message warning sign would be excessively activated, and the system would lose its effectiveness. Therefore, it is desirable to adjust speed threshold parameters to increase system effectiveness. The centre of gravity for each truck is estimated from the rollover threshold tables.

As an option to the main classification and detection sensors, on-scale detectors may be incorporated into each lane to ensure that the trucks passing the sensor arrays are fully within the active zone of the system, and are not straddling a lane. The on-scale detectors effectively eliminate the possibility that a truck will receive a message for a speed that is higher than is safe for that particular truck.

The electronic message sign is conveniently installed directly below a traditional information sign, (e.g., a "danger ahead" sign with the image of a truck rolling over), which indicates the ramp advisory speed. The message sign is not a continuous beacon which flashes continuously. Rather, it is a sign which is activated only when a truck is exceeding the rollover threshold speed at a particular curve. A message for a specific truck is more effective, since the sign is an exception to regular signing and not a common background feature.

(C) Vehicle Ramp Advisory System

Another embodiment of this invention, the Vehicle Ramp Advisory System (VRAS), for detecting potential rollover of truck approaching a curve, will now be described with reference to FIGS. 9 through 11B. This embodiment of this invention, namely the VRAS, is an intelligent transportation system which helps prevent rollover accidents and out-of-control vehicles on sharp curves, e.g., freeway exit ramps.

(i) Description of FIG. 9

FIG. 9 shows the components of a VRAS traffic monitoring system which is deployed between an exit 90 of a highway 91 and a curved ramp 92 of the exit road 93. The system comprises a first set of above-road electro-acoustic sensor arrays 1711F which are directed at the left hand lane of the exit road upstream of the curve 92, as station # 1 sensors. Above-road electro-acoustic sensor arrays 1711F comprise a set of above-road electro-acoustic sensor arrays which are similar to those used in the aspect described in FIG. 1 to FIG. 5, and so need not be described further. A typical orientation thereof will, however, be described hereinafter in FIG. 18 to FIG. 21. The system also comprises a second set of above-road electro-acoustic sensor arrays 1711G which are directed at the right hand lane of the exit road upstream of the curve 92, as station #2 sensors. Since the operation is the same for both sets of above-road electro-acoustic sensor arrays, only the above-road electro-acoustic sensor arrays in the left hand lane will be described further. A traffic signal device, in the forth of an electronic message sign 98, is disposed downstream from above-road electro-acoustic sensor arrays 1711F, and is associated with the left hand traffic lane, for example, above it or at an elevated height adjacent to it. The exit road has two lanes and hence a duplicate set of a traffic signal device 98A is provided for the right hand lane downstream from above-roadelectro-acoustic sensor arrays 1711G.

As an optional feature, the system may also comprises a third set of above-road electro-acoustic sensor arrays 1711H which are directed at the left hand lane of the exit road downstream from the first set of above-road electro-acoustic sensor arrays 1711E, but upstream of the traffic signal device 98E, as station # 3 sensors. Above-road electro-acoustic sensor arrays 1711H comprise electro-acoustic sensors which are similar to above-road electro-acoustic sensor arrays 1711F. In this optional feature, the system may also comprises a fourth set of above-road electro-acoustic sensor arrays 1711I, which are directed at the right hand lane of the exit road downstream of the first set of above-road electro-acoustic sensor arrays 1711G but upstream of the traffic signal device 98F, as station # 4 sensors. Above-road electro-acoustic sensor arrays 1711I comprise above-road electro-acoustic sensor arrays which are similar to above-road electro-acoustic sensor arrays 1711G.

(ii) Description of FIG. 10

Referring now to FIG. 10, the station # 1 sensors (above-road electro-acoustic sensor arrays 1711F), the station # 2 sensors (above-road electro-acoustic sensor arrays 1711G), the station # 3 sensors (above-road electro-acoustic sensor arrays 1711H), the station # 4 sensors (above-road electro-acoustic sensor arrays 1711I) and the electronic message signs 68, 68A are connected to a roadside controller 99, 99B, which comprises the same basic components as the roadside controller of the aspect described in FIG. 1 to FIG. 5 above. The roadside controller 99 includes a microcomputer 99B, and a modem 70. The microcomputer 99B contains software and data for processing the sensor signals to give vehicle class based on vehicle length, number of axles and axle spacings, and vehicle speed. The microcomputer 99B is preprogrammed, upon installation, with site-specific data, e.g., camber and radius of the curve, and the various distances between the above-road electro-acoustic sensor arrays and the curve. In use, the processor uses the site-specific data, and the truck-specific data derived from the above-road electro-acoustic sensor arrays 1711F, 1711G, 1711H, 1711I, to compute deceleration between the above-road electro-acoustic sensor arrays 1711F, 1711H, and above-road electro-acoustic sensor arrays 1711G, 1711I and to predict the speed at which the truck will be travelling when it arrives at the curve 92. Taking into account height and class of the truck, and camber and radius of the curve, the processor determines a maximum safe threshold speed at which that particular class of truck should attempt to negotiate the curve. If the predicted speed exceeds this maximum, implying a risk of rollover occurring, the processor activates the message sign to display a warning, e.g., "TRUCK REDUCE SPEED!" or some other suitable message. The message sign is directional and is viewed only by the driver of the passing truck. The threshold speed is programmable and can be inputted or changed by the system user.

More specifically, in this aspect of this invention, the VRAS uses above-road electro-acoustic sensor arrays which are known by the trade-mark SmartSonic™, to detect vehicles and to classify them according to type by means of determination of the length of the truck and truck classification tables which are loaded into the computer. All information from the above-road electro-acoustic sensor arrays is processed in real time, just milli-seconds after the vehicle has passed through the detection zone. If the speed of the vehicle (as determined by the above-road electro-acoustic sensor arrays) exceeds the posted advisory speed, and if the vehicle is classified as a truck, a warning status is assigned to the vehicle. The warning status produces a trigger signal which activates the message sign. The message sign is only activated for vehicles which are assigned a warning status and is specific to that particular vehicle. Since the message signs are only activated for particular vehicles, they are more noticeable and are more likely to achieve the desired response of vehicle speed reduction.

The VRAS is meant to complement the existing static signing by providing a warning and drawing the attention of a driver to the fact that the safe speed has been exceeded and that the vehicle should slow down to avoid a potential rollover or accident resulting from a loss of control. It should be recognized that the accuracy of the system is dependent on site conditions and traffic flow characteristics.

While it is not desired to be limited to any particular type of message sign, in one non-limiting embodiment, the message signs are fiber optic message signs. The station #1 sensors, station #2 sensors, station #3 sensors, station #4 sensors, and electronic message signs are all interlocked, e.g., by suitable cables disposed within, e.g., a conduit 97 of about ½" diameter. Typically, the distance between station #1 sensors 1711F and electronic message sign 98F is about 250 feet, and the distance between station #2 sensors 1711G and electronic message sign 98G is likewise about 250 feet.

As will be further described with reference to FIG. 16, the above-road electro-acoustic sensor arrays are mounted on poles.

A truck entering the system passes through the detection zones of the above-road electro-acoustic sensor arrays. As noted above, the above-road electro-acoustic sensor arrays are mounted on poles and are aimed at specific areas on the roadway through which the traffic will pass. Since two lanes are to be equipped at this site, above-road electro-acoustic sensor arrays are installed on both shoulders. For each lane, two detection zones are used. The above-road electro-acoustic sensor arrays provide data which is processed by the controller electronics to determine inter alia vehicle speed.

If a warning status is assigned by the system, the roadside message signs will be activated for that particular vehicle. The message sign will remain on for a specified period of time, until the vehicle has passed the roadside static sign. A single controller is used to receive and process information from all of the above-road electro-acoustic sensor arrays plus control the operation of the message signs. The electronics are compact and therefore easy to mount on the same pole that is used to mount the sensors. In one embodiment of this invention, where only Station #1 above-road electro-acoustic sensor arrays and Station #2 above-road electro-acoustic sensor arrays are used, a timer will shut off the message sign based on the time the vehicle is detected and the vehicle speed.

While it is not desired to be limited to any particular class of message sign, one non-limiting example of such message sign is a fiber optics message sign. One such non-limiting example of the fiber optics message sign is a highly visible roadside message sign to provide a real-time, eye-catching message to truck drivers. Such non-limiting example of a simple single message fiber optic message sign may be used to communicate clearly to the driver. For example, the fiber optic message sign may contain the message:

TRUCK
REDUCE
SPEED

While it is not desired to be limited to any particular manner of control of the illumination of the message sign, one non-limiting example of the control of the illumination of the message sign is by electronics. When a warning message is necessary, the system turns the message sign on so that the targeted driver sees the message. In one non-limiting example, the timing of the activation and duration of the activation of the message sign may be controlled to give optimum visibility and viewing time to the driver, while minimizing the possibility of a following driver viewing the message sign in error.

While it is not desired to be limited to any particular intensity of the sign, one non-limiting example of the intensity of the illumination of the message sign is one which has a minimum of two different and adjustable intensities for day and night light levels, ensuring good visibility. While it is not desired to be limited to any particular message sign characters, in one non-limiting example, such message sign characters may have a minimum height of about 10" and may be readable from a distance of at least about 500 feet under all lighting conditions.

While it is not desired to be limited to any particular structure of housing for the message sign, one non-limiting example of the housing of the message sign is an aluminum alloy with a minimum thickness of about 0.125". While it is not desired to be limited to any particular type of construction of housing for the message sign, one non-limiting example of such housing is one in which all exterior seams may be welded and made smooth. In one non-limiting example, the entire housing may be made weatherproof. In one non-limiting example, a rubber seal or other approved seal material may be provided around the entire door to ensure a watertight enclosure.

While it is not desired to be limited to any particular structure of the fiber optic network of such fiber optic message sign, one non-limiting example of such fiber optic network may be one which consists of fiber optic bundles which are arranged to form the required letters. In such non-limiting example, each bundle may consist of a minimum of about 600 fibers, ground smooth and polished at the input and output ends for maximum light transmission. In such non-limiting example, spare bundles numbering at least about 5% of the total bundles are connected to each light source for future replacement of damaged bundles.

While it is not desired to be limited to any particular type of light source, one non-limiting example of the light source for each bundle may be from two 50 watt quartz halogen lamps with an average of at least about 6000 hour rated life. In such non-limiting example, a minimum of four bulbs may be provided for the entire message sign. In such non-limiting example, no more than about 50% of the illumination of each bundle may come from a single bulb. In such non-limiting example, in the event of the failure of a single bulb in a pair, the bundles continue to be illuminated at about 50% of normal brightness. In such non-limiting example, alternating bundles in a message sign face may be connected to different light sources, such that a lamp failure will affect only alternating pixels.

In another embodiment, where Station # 3 above-road electro-acoustic sensor arrays and Station # 4 above-road electro-acoustic sensor arrays are used, these above-road electro-acoustic sensor arrays, which determine deceleration and predict speed, can be used to turn off the message sign based on that speed. In this embodiment, therefore, the operation of the message signs is controlled by the vehicle speed.

The controller electronics passes the real time vehicle information to a micro-controller. All vehicle information is stored in the memory of the controller and is retrievable manually at the controller cabinet. Data which is collected by the system includes vehicle counts, vehicle speed, and vehicle length (according to classification groups). The microcontroller receives and processes vehicle information to make a decision on the message sign operation. If required, the controller activates and deactivates the real time warnings provided for drivers at the appropriate time.

The above-road electro-acoustic sensor arrays are used to provide vehicle speed information. The above-road electro-acoustic sensor arrays may be mounted on a pole at a height of about 20 feet just off the shoulder of the road, as will be described hereafter with reference to FIG. 16. Each of the above-road electro-acoustic sensor arrays is directed at a particular area on the roadway. As will be described hereafter with reference to FIG. 18, a bank of microphones in the above-road electro-acoustic sensor arrays monitors the acoustic energy from the detection zone. The noise is filtered and analyzed to determine vehicle presence, type, and speed, as will be described hereafter with reference to FIG. 19 to FIG. 21.

The system operates as a vehicle advisory system by collecting vehicle speed and classification information. The passage of vehicles is monitored in real time, and determines whether the maximum safe entrance speed for that particular vehicle is exceeded. The system triggers the roadside message sign only if a vehicle is exceeding the posted maximum speed.

Raw vehicle records generally will include the following data, namely, site identification, time and date of passage, lane number, vehicle sequence number, vehicle speed, and code for invalid measurement.

The sequence of events for a vehicle record and message generation is outlined as follows:

1. Vehicle Data Collection:

The operation of the VRAS is triggered by a vehicle passing through the detection zones of the above-road electro-acoustic sensor arrays. When a vehicle passes through such detection zones, the system creates a new vehicle record to contain all of the information obtained for that vehicle. After passing through the detection zone, the controller processes the vehicle record to determine classification (length class) and speed.

2. Warning Status Determination:

2a. If the vehicle speed which was recorded during vehicle data collection is greater than the posted advisory speed, a warning status will be assigned specifically to that vehicle.

2b. If there is a second set of above-road electro-acoustic sensor arrays, such above-road electro-acoustic sensor arrays determine deceleration and calculate predicted speed.

3. Message sign activation:

If a warning status is assigned to the vehicle, the message sign will be activated. As the vehicle continues along the roadway, the message sign will be deactivated according to a timer if the predicted speed is now below the posted advisory speed, or, according to Step 2a, if the actual speed is now below the posted advisory speed. Thus, the message sign will only be activated when necessary.

(iii) Description of FIGS. 11A and 11B

The sequence of operations as a vehicle is processed by the system will now be described with reference to FIG. 11A and FIG. 11B. When the vehicle passes under above-road electro-acoustic sensor arrays 1711F, the analysis of the sound determines whether the vehicle is a truck or is not a truck at step 11.1. The processor determines, in step 11.2, whether or not a vehicle has been accurately detected. If it has not, step 11.3 records an error. If the vehicle has been detected accurately, and if no weigh-in-motion (WIM) scale is present, a typical weight and configuration of the truck is assumed. The microcomputer creates a truck record containing this information, namely, axle spacings and number of axles, length and electro-acoustic data, together with the time and date at step 11.4. If a weigh-in-motion (WIM) scale is present at 11.31, it uses information which is derived from the weigh-in-motion (WIM) scale, together with the time and date, to create a vehicle record. In decision step 11.5, from the information at steps 11.4 or 11.32, it compares the measurements with a table of vehicle classes to determine whether or not the vehicle is of a class listed, specifically one of various classes of truck. If it is not, the processor takes no further action as indicated in step 11.6. If decision step 11.5 determines that the vehicle is a truck, and that it was accurately detected, then, in step 11.14, the processor determines whether or not vehicle height is greater than a threshold value (e.g., about eleven feet). If the vehicle height is greater than the threshold value, the processor proceeds to step 11.15 to identify it as a particular class of truck. If the height of the vehicle is less than the threshold value, steps 11.15 and 11.16 identify the truck class and type.

Having identified the truck class and type in step 11.15 or in step 11.16, the processor proceeds to access its stored rollover threshold tables in step 11.17 to determine a threshold speed for that particular truck safely to negotiate the curve. In step 11.18, the measured speed at station # 1 is the speed of the truck when it arrives at the beginning of the curve 92. Step 11.19 compares the predicted speed with the rollover threshold speed. If the predicted speed is lower, no action is taken, as indicated by step 11.20. If the predicted speed is higher than the rollover threshold speed, however, step 11.21 activates the message sign 68 for the required period of time to warn the driver of the truck to slow down.

If the system does not include station #3 sensors, a timer determines, from the speed of the vehicle and the time lapse, when to deactivate the warning sign at step 11.2*b*.

If it is desired to provide deceleration calculations, the system may include station #3 above-road electro-acoustic sensor arrays, and the vehicle is detected by the above-road electro-acoustic sensor arrays at station #3 in step 11.22. The processor determines in step 11.23 whether or not a vehicle has been accurately detected. If it has not, step 11.34 records an error. If the vehicle has been detected accurately, the microcomputer creates a truck record of the speed together with the time and date at step 11.25. If such speed is lower than the rollover threshold speed, the timer sensed deactivation of the warning sign is overridden, but step 11.26 deactivates the message sign.

Step 11.27 represents the sequence of steps which are taken by the processor to process the corresponding signals from the above-road electro-acoustic sensor arrays 1711F and 1711G to ascertain the speed of the truck and the type of truck, and to create a secondary record. Subsequent transmission of the truck data which is derived from all three sensor arrays 64, 65, 66 to a central computer, or retrieval in one of the various alternatives outlined above, is represented by step 11.23.

The controller 99 processes the signals from all the electro-acoustic sensor arrays to produce a secondary truck record. As described for other embodiments, data from the controller 99 can be downloaded to a remote computer and truck records from the first and third above-road electro-acoustic sensor arrays compared to determine the speed of the truck before and after the message sign. This allows statistics to be accumulated showing the number of trucks slowing down when instructed to do so by the message sign, thereby allowing evaluation of system effectiveness.

The system algorithm is site specific to accommodate certain site characteristics. The software can be compiled on any curve site with a known camber and radius. The data is stored on site in the programmable controller and is retrievable either by laptop computer on site or remotely via modem communication. The controller also has an auto-calibration feature. If the system fails for any reason, an alert signal is transmitted to the host computer via modem, informing the system operators of a system malfunction.

The programmable controller allows the system operator to adjust maximum allowable safe speeds, based on collected data on truck speeds at particular locations. For example, if the maximum safe speed is set at the posted speed limit, but if the majority of trucks are exceeding the posted speed limit at a particular location, then the variable message warning sign would be excessively activated, and the system would lose its effectiveness. Therefore, it is desirable to adjust speed threshold parameters to increase system effectiveness. The centre of gravity for each truck is estimated from the rollover threshold tables.

As an option to the main classification and detection sensors, on-scale detectors may be incorporated into each lane to ensure that the trucks passing the sensor arrays are fully within the active zone of the system, and are not straddling a lane. The on-scale detectors effectively eliminate the possibility that a truck will receive a message for a speed that is higher than is safe for that particular truck.

The electronic message sign, namely, "TRUCK REDUCE SPEED !", conveniently is installed directly below a traditional information sign, (e.g., a "danger ahead" sign with the image of a truck rolling over), which indicates the vehicle ramp advisory speed. The message sign is not a continuous beacon which flashes continuously. Rather, it is a sign which is activated only when a truck is exceeding the rollover threshold speed at a particular curve. A message for a specific truck is more effective, since the sign is an exception to regular signing and not a common background feature.

(D) Traffic Signal Pre-Emption System

A third aspect of this invention is a traffic signal pre-emption system, specifically a traffic signal pre-emption system which monitors truck speed at successive points along a steep downgrade to determine when there is a "runaway" truck and pre-empts traffic signals along the path of the runaway truck, will now be described with reference to FIG. 12 through to FIG. 15B.

The downhill speed warning system may be installed at the approach to a long, steep downhill grade, perhaps at the summit of a mountain pass. The downhill speed warning system comprises a system of above-road electro-acoustic sensor arrays and a programmable controller for classifying commercial vehicles, i.e. trucks, while they are in motion. Using that information and stored information which is specific to the downgrade, the system provides real-time safe descent speed calculations, and advises drivers of the safe descent speed by variable message signs, all before the truck begins to descend the downgrade. This embodiment may also be used in conjunction with hazards at other traffic-light-controlled intersections, or as a warning sign activator or preemptor at blind intersections.

(i) Description of FIG. 12, FIG. 13 and FIG. 14

FIG. 12 depicts a section through a steep downgrade 1202 with an intersection at the bottom. The intersection is controlled by traffic signals 1203 of conventional construction, i.e., the usual red, yellow and green lights, which are controlled by a traffic signal controller 1402 (FIG. 14). A truck 1201 is shown at the top of the downgrade. As the truck 1202 descends the downgrade, it will traverse a set of above-road electro-acoustic sensor arrays shown in more detail in FIG. 13. As in the other embodiments, a set of above-road electro-acoustic sensor arrays is provided for each traffic lane. A camera 1204, whose purpose will be described hereinafter, is also provided, as is a utilities box 1205.

Each set of above-road electro-acoustic sensor arrays, namely station # 1 sensors, comprise above-road electro-acoustic sensor arrays 1711J, 1711K, which are similar to those described previously, or in-road sensors, 1305A, 1306 1306A, and 1307, 1307A, which are spaced apart in the road surface along the downgrade. In-road sensors 1305, 1305A, 1306, 1306A, each comprise vehicle presence and direct axle detectors which are similar to those described previously, and are spaced 150 meters apart. In-road sensor 1307 is positioned 150 meters beyond the sensor array 1305 and comprises a vehicle presence detector and a direct axle sensor. Above-road electro-acoustic sensor arrays 1711 (namely, 1711J, 1711K), or in-road sensors 1305, 1305A, 1306, 1306A and 1307, 1307A, are connected to a roadside controller 1408 similar to that of the other embodiments, including a processor and a modem 1409 (FIG. 14). As shown in FIG. 14, the roadside controller is connected to traffic signal controller 1401 which controls the sequence of the traffic signals 1402 and also a camera 1401 which is located adjacent to the traffic signals.

As a vehicle traverses the zones of the above-road electro-acoustic sensor arrays, namely station #1 sensors, station #2 sensors and station #3 sensors, the processor determines the truck type, and the speed, using the signals from the above-road electro-acoustic sensor arrays 1711 (namely, 1711J, 1711K), or the in-road sensors 1105, 1306. If the vehicle is a truck, using the preprogrammed site-specific data, including site characteristics, e.g., length and severity of the downgrade, the processor computes a maximum speed for that particular class of truck. From the signals from the above-road electro-acoustic sensor arrays 1711J, 1711K, or the in-road sensors 1306, 1306A, the processor determines whether or not the truck is exceeding the calculated maximum speed and whether the speed of the truck has increased significantly, or decreased, as determined either from above-road electro-acoustic sensor arrays 1711J, 1711K, or between the in-road sensors 1305, 1305A, 1306, 1306A. If the speed of the truck as it traverses the above-road electro-acoustic sensor arrays 1711K or the in-road sensors 1306, 1306A, is greater than the calculated maximum value, indicating that the truck cannot stop safely at the intersection, the processor transmits a pre-empt signal to the traffic signal controller 1401 which ensures that the traffic signals are in favour of the truck when it arrives at the intersection.

Description of FIG. 15A and 15B

The specific sequence of operations is illustrated in FIGS. 15A and 15B. On receipt of a signal from above-road electro-acoustic sensor arrays 1711D, or from in-road sensors 1305, the processor determines, in steps 15.1 and 15.2, whether or not a truck has been accurately detected. If not, step 15.3 records an error. If the truck has been accurately detected, the processor processes the signals from above-road electro-acoustic sensor arrays 1711 (namely 1711J, 1711K), or signals from in-road sensors 1305, 1305A, 1306, 1306A, in step 15.4, to compute vehicle speed, bumper to bumper length, axle spacings and number of axles, measures or assumes the weight, and adds the time and date to the data before recording it. If the controller has problems processing any of the signals from the above-road electro-acoustic sensor arrays, or the in-road sensors a warning or error is added to the vehicle information to indicate that the calculated values may be in error. From the vehicle information, the processor uses stored data or "look-up" tables to determine vehicle type, based upon the length of the vehicle, the number of axles and the distance between each axle. From this classification, the processor determines, in decision step 15.5 whether or not the vehicle is a truck. If it is not, the processor takes no further action with the data, as indicated in step 15.6. If the vehicle data indicates that it is a truck, however, the processor computes, in step 15.7, a maximum safe speed for that truck based upon its configuration.

Upon receipt of a signal from the second above-road electro-acoustic sensor arrays 1711K, or from in-road sensors 1306, 1306A, in step 15.8, the processor again determines whether or not the truck has been accurately detected (step 15.9). If it has not, a truck error is recorded in step 15.10. If the controller has problems processing any of the signals from the above-road electro-acoustic sensor arrays, or from the in-road sensors, a warning or error is added to the truck information to indicate that the calculated values may be in error. If the truck has been accurately detected at the above-road electro-acoustic sensor arrays 1711J, 1711K, or at in-road sensors 1306, 1306A, the processor processes the signals from above-road electro-acoustic sensor arrays 1711J, 1711K, or from in-road sensors 1306, 1306A, in step 15.11 to determine the truck speed, bumper to bumper length, axle spacings and number of axles, and measures or assumes the weight. In step 15.12, it compares the actual truck speed measured at above-road electro-acoustic sensor arrays 1711K or at in-road sensors 1305, 1305A, with the actual truck speed which was measured at above-road electro-acoustic sensor arrays 1711J, or at in-road sensors 1306, 1306A. If the speed at sensor # 1 is greater than the speed at sensor # 2, the speed at sensor # 1 is used, at decision step 15.23. If the speed at sensor # 1 is not greater than the speed at sensor # 2, the speed at sensor # 2 is used, at decision step 15.22. The controller, by the use of the selected speed, obtains, from tables, a maximum stopping threshold for that truck classification. The stopping threshold will be based on standardized tables for each truck configuration.

When a signal is received from above-road electro-acoustic sensor arrays 1711J, 1711K, or from in-road sensors 1306, 1306A, the processor again checks that the truck has been detected accurately (steps 15.14, 15.15) and records an error if it has not. If it has, in step 15.16 the processor processes the signals from above-road electro-acoustic sensor arrays 1711 to produce a record of to the truck speed, bumper to bumper length, axle spacings and number of axles, and measures or assumes the weight, and adds a time and date stamp as before. If the processor has problems processing any of the signals from the above-road electro-acoustic sensor arrays, or from the in-road sensors, a warning or error is added to the truck information to indicate that the calculated values may be in error. Based on the stopping threshold information determined in step 15.13, and the truck speed, as determined by above-road electro-acoustic sensor arrays 1711K, or the in-road sensors 1307, the processor will determine in step 15.17 whether or not the truck will be able to stop before the intersection if the traffic signal requires it. If decision step 15.17 indicates that it will be able to stop, the processor takes no further action as in step 15.18. However, if decision step 15.7 indicates that it will not be able to stop, the processor sends a signal to the traffic signal controller 100 as indicated in step 15.19, causing it to pre-empt the traffic signal to keep the traffic flowing continuously in the direction the truck is travelling. The pre-emption signal will override the traffic signal sequence either to change the traffic signal to favour the passage of the vehicle or, if it is already in its favour, to ensure that the traffic signal does not change for a suitable interval. The duration of the traffic signal pre-emption is based upon site specific geometries and varies from site to site. The central controller can also be programmed to pre-empt the traffic signal as a precautionary measure when a warning or error occurs at any or all of the above-road electro-acoustic sensor arrays 1711J, 1711K or the in-road sensors 1305, 1305A, 1306, 1306A, 1307 and 1307A.

As described for other embodiments, as an option to the main detection sensors, on-scale detectors may be incorporated into each lane to ensure that the vehicles passing the sensor arrays are fully within the active zone of the system, and are not straddling a lane. The on-scale detectors effectively eliminate the possibility that a truck will receive a message for a speed that is higher than is safe for that particular truck.

It will be appreciated that there is potential for abuse, i.e., drivers deliberately causing the system to pre-empt the traffic signals. Accordingly, whenever the traffic signal controller 1203 receives a pre-emption signal, it operates the roadside camera 1204, as indicated by step 15.20, to capture an image of the vehicle which caused the pre-emption signal. The video record will provide a means of identifying vehicles for safety and regulatory purposes.

As in the case of the other embodiments, all vehicle data collected from above-road electro-acoustic sensor arrays 1711 (namely, 1711J, 1711K), or from in-road sensors, (namely, 1305, 1305A, 1306, 1306A 1307 and 1307A) can be transmitted, via modem, to a central computer for analysis at step 15.21.

In any of the above-described embodiments of this invention, the controller may be reprogrammed with fresh data and table information, conveniently by means of, for example, a laptop computer. Moreover, instead of the data being transmitted via modem to the central computer, the data could be stored in the memory of the controller and retrieved periodically by, for example, a laptop computer. A remote terminal can be used to provide full remote control over the operation of the system, including controls, e.g., disabling the system or overriding signal pre-emption where there is a false alarm.

An advantage of traffic monitoring systems embodying embodiments of the present invention is that they perform real-time computations using information specific to a particular vehicle without necessarily knowing the weight of the vehicle and information specific to a particular potential hazard to determine what message, if any, to display to the driver of the vehicle or, in the case of the traffic signal pre-emption system, whether or not to pre-empt the regular traffic signal. Hence, the system recommendations are tailored to the site and the specific vehicle. Consequently, there is less likelihood of erroneous or untimely messages being displayed and hence increased likelihood that drivers will heed the messages and/or not abuse the system.

In each embodiment of this invention, the controller may also have an auto-calibration feature. If the system fails for any reason, an alert signal is transmitted to the host computer via modem, informing the system operators of a system malfunction.

The set of above-road electro-acoustic sensor arrays 1711, (namely 1711A, 1711B, 1711C, 1711D, 1711E, 1711F, 1711G, 1711H, 1711I, 1711J and 1711K) are based on an improvement on a system which is used to monitor highway traffic, and will be described more fully hereinafter with reference to FIGS. 17 to 21.

(E) Description of Electro-Acoustic Sensor Arrays Mount (i) Description of FIG. 16

As seen in FIG. 16, the electro-acoustic sensor arrays 1711, now designated 1601A and 1601B, are mounted on a mast arm 1602. The mast arm 1602 is supported on a sensor array mounting pole 1603, which includes a pole-mounted cabinet 1604. The pole-mounted cabinet houses the controller electronics of the above-road electro-acoustic sensors, known by the trade-mark SmartSonic™. The pole-mounted cabinet provides protection in a harsh outdoor environment, including protection from vandalism, rain, sleet, snow, dripping water, corrosion, hosedown, splashing water, and oil or coolant seepage. The sensor array mounting pole 1604 is optionally provided with a breakaway base 1605. Beneath the roadway or the shoulder of the roadway is an electrical junction box 1606.

Typically the mast arm is about 10 feet long, and the sensor array mounting pole is about 20 feet high. The above-road electro-acoustic sensor arrays are mounted on the poles 1604 and are aimed at specific areas on the roadway through which the traffic will pass. Since two lanes are to be equipped at this site, above-road electro-acoustic sensor arrays are installed on both shoulders. For each lane, two detection zones are used. The above-road electro-acoustic sensor arrays provide data which is processed by the controller electronics to determine inter alia, a vehicle speed.

(F) Electro-Acoustic Sensors

FIG. 17 to FIG. 21 will now explicitly describe the previously mentioned above-road electro-acoustic sensor arrays 1711, (namely 1711A, 1711B, 1711C, 1711D, 1711E, 1711F, 1711G, 1711H, 1711I, 1711J and 1711K). Each motor vehicle using a highway radiates acoustic energy from the power plant (e.g., the engine block, pumps, fans, belts, etc.) and from its motion along the roadway (e.g., tire noise due to friction, wind flow noise, etc.). While the energy fills the frequency band from DC up to approximately 16 KHz, there is a reliable presence of energy from 3 KHz to 8 KHz. Thus an analysis of such energy enables the classification of the vehicle as a truck or as not a truck.

(i) Description of FIG. 17

FIG. 17 depicts an illustrative embodiment of an above-road electro-acoustic sensor array constituting an essential element of all of the systems of embodiments of the present invention, which includes the monitoring of a predetermined area of roadway, called a "predetermined detection zone", for the presence of a motor vehicle and for the classification of such vehicle as a truck within that area. The salient items in FIG. 17 are roadway 1701, automobile 1703, truck 1705, detection zone 1707, microphone array 1711, microphone support 1709, detection circuit 1715 and interface circuit 1719 in a roadside cabinet (not shown), electrical bus 1713, electrical bus 1717 and lead 1721, which conducts a loop relay signal to a command centre.

A typical deployment geometry is shown in FIG. 17. In that particular geometry, the horizontal distance of the sensor from the nearest lane with traffic is assumed to be less than about 15 feet. The vertical height above the road is advantageously between about 20 and about 35 feet, depending on performance requirements and available mounting facilities. It will be clear to those skilled in the art that the deployment geometry is flexible and can be modified for specific objectives. Furthermore, it will also be clear to those skilled in the art how to position and orient microphone arrays 1711 so that they are well suited to receive sounds from predetermined detection zone 1707.

Each omnidirectional microphone in microphone array of the above-road electro-acoustic sensor arrays 1711 receives an acoustic signal which comprises the sound which is radiated, inter alia, from automobile 1703, or from truck 1705, and ambient noise. Each microphone in microphone array 1711 then transforms its respective acoustic signal into an analog electric signal and outputs the analog electric signal on a distinct lead on electrical bus 1713 in ordinary fashion. The respective analog electric signals are then fed into detection circuit 1715.

To determine the presence or passage of a motor vehicle in predetermined detection zone 1707, the respective signals from the microphone array of the above-road electro-acoustic sensor arrays 1711 are processed in ordinary fashion to provide the sensory spatial discrimination needed to isolate sounds emanating from within predetermined detection zone 1707. The ability to control the spatial directivity of microphone arrays of the above-road electro-acoustic sensor arrays 1711 is called "beam-forming". It will be clear to those skilled in the art that electronically-controlled steerable beams can be used to form multiple detection zones. The analysis of the sounds which emanate from the predetermined detection zone 1707 broadly classifies a vehicle according to its length, the number of axles and the spacing of the axles, i.e., as a truck or not as a truck.

(ii) Description of FIG. 18

As shown in FIG. 18, microphone array of the above-road electro-acoustic sensor arrays 1711 preferably comprises a plurality of acoustic sensors 1801, 1803, 1805, 1807, 1809, 1811, 1813, 1815 and 1817, (e.g., omni-directional microphones), which are arranged in a geometrical arrangement known as a Mill's Cross. For information regarding Mill's Cross arrays, the interested reader is directed to Microwave Scanning Antenna, R. C. Hensen, Ed., Academic Press (1964), and *Principals of Underwater Sound* (3rd. Ed). R. J. Urick (1983). While microphone array 1711 could comprise only one microphone, the benefits of multiple microphones (to provide signal gain and directivity, whether in a fully or sparsely populated array or vector), will be clear to those skilled in the art. It will also be clear to those skilled in the art how to baffle microphone array 1711 mechanically so as to attenuate sounds coming from other than predetermined detection zone 1707 and to protect microphone array 1711 from the environment (e.g., rain, snow, wind, UV, etc.).

The microphone arrays of the above-road electro-acoustic sensor arrays 1711 are advantageously rigidly mounted on support 1709 so that the predetermined relative spatial positionings of the individual microphones are maintained. The microphone arrays of the above-road electro-acoustic sensor arrays 1711 may (as previously indicated) include a set of microphone arrays which may be mounted on a mast arm which is supported on a pole, and another set of microphone arrays which may be mounted the pole itself. Alternatively, the sets of microphone arrays may be mounted on a highway overpass. The height above the road may be about 20 to about 35 feet to aim at a point of up to about 25 feet. The detection zone typically may cover an area of about 4 to about 8 feet by about 6 to about 12 feet.

(G) Detection Circuit (i) Description of FIG. 19

Referring to now to FIG. 19, detection circuit 1715 (See FIG. 17) advantageously comprises bus 1713, (See FIG. 17) bus 1901, vertical summer 1905, analog-to-digital converter 1913, finite-impulse-response (FIR) filter 1917, bus 1903, horizontal summer 1907, analog-to-digital converter 1915, finite-impulse-response (FIR) filter 1919; common multiplier 1921 and common comparator 1925. The electric signals from microphone 1801, microphone 1803, microphone 1805, microphone 1807 and microphone 1809 (as shown in FIG. 18) are fed, via bus 1901, into vertical summer 1905 which adds them in well-known fashion and feeds the sum into analog-to-digital converter 1913. While in the illustrative embodiment, vertical summer 1905 performs an unweighted addition of the respective signals, it will be clear to those skilled in the art that vertical summer 1905 can alternatively perform a weighted addition of the respective signals so as to shape and steer the formed beam (ie., to change the position of predetermined detection zone 1707). It will also be clear to those skilled in the art that illustrative embodiments of the above-road electro-acoustic sensor arrays providing systems constituting essential elements of various embodiments of the present invention can comprise two or more detection circuits, so that one microphone array can gather the data for two or more detection zones, in each lane or in different lanes.

Analog-to-digital converter 1913 receives the output of vertical summer 1905 and samples it at about 32,000 samples per second in well-known fashion. The output of analog-to-digital converter 1913 is fed into finite-impulse response filter 1917.

Finite-impulse response filter 1917 is preferably a band-pass filter with a lower passband edge of about 4 KHz, an upper passband edge of about 6 KHz and a stopband rejection level of about 60 dB below the passband (i.e., stopband levels providing about 60 dB of rejection). It will be clear to those skilled in the art how to make and use finite-impulse-response filter 317.

The electric signals from microphone 1811, microphone 1813, microphone 1805, microphone 1815 and microphone 1817 (as shown in FIG. 18) are fed, via bus 1903, into horizontal summer 1907 which adds them in well-known fashion and feeds the sum into analog-to-digital converter 1915. While in the illustrative embodiments, horizontal summer 1907 performs an unweighted addition of the respective signals, it will be clear to those skilled in the art that horizontal summer 1907 can alternatively perform a weighted addition of the respective signals so as to shape and steer the formed beam (i.e., to change the position of predetermined detection zone 1707). It will also be clear to those skilled in the art that illustrative embodiments of the above-road electro-acoustic sensor arrays providing systems constituting essential elements of various embodiments of the present invention can comprise two or more detection circuits, so that one microphone array can gather the data for two or more detection zones, in each lane or in different lanes.

Analog-to-digital converter 1915 receives the output of horizontal summer 1905, and samples it at about 32,000 samples per second in well-known fashion. The output of analog-to-digital converter 1913 is fed into finite-impulse response filter 1919.

Finite-impulse response filter 1919 is preferably a band-pass filter with a lower passband edge of about 4 KHz, an upper passband edge of about 6 KHz and a stopband rejection level of about 60 dB below the passband (i.e., stopband levels providing about 60 dB of rejection). It will be clear to those skilled in the art how to make and use finite-impulse-response filter 1919.

Multiplier 1921 receives, as input, the output of finite-impulse-response filter 1917 and finite-response-filter 1919 and performs a sample-by-sample multiplication of the respective inputs and then performs a coherent averaging of the respective products. The output of multiplier 1921 is fed into comparator 1925. It will be clear to those skilled in the art how to make and use multiplier 1921.

Comparator 1925 advantageously, on a sample-by-sample basis, compares the magnitude of each sample to a predetermined threshold and creates a binary signal which indicates whether a motor vehicle is within predetermined detection zone 1707. While the predetermined threshold can be a constant, it will be clear to those skilled in the art that the predetermined threshold can be adaptable to various weather conditions and/or other environmental conditions which can change over time. The output of comparator 1925 is fed into interface circuitry 1719.

Interface circuitry 1719 receives the output of detection circuitry 1715 and preferably creates an output signal such that the output signal is asserted when a motor vehicle is within predetermined detection zone 1707 and such that the output signal is retracted when there is not motor vehicle within the predetermined detection zone 107. Interface circuitry 1719 also makes any electrical conversions necessary to interface to the circuitry at the command centre of the highway department. Interface circuitry 119 can also perform statistical analysis on the output of detection circuitry 1715 so as to output a signal which has other characteristics than those described above.

(H) Maximally-Digital Implementation (i) Description of FIG. 20

FIG. 20 illustrates a practical, maximally-digital, implementation. The microphone array 2000 comprises two vertical elements $V_1$ and $V_2$ and two horizontal elements $H_1$ and $H_2$. As shown, each element has three microphones, which was found to be practically sufficient. Each of the four elements $V_1$, $V_2$, $H_1$ and $H_2$ feeds a respective analog filter 2001, 2002, 2003, 2004, to attenuate unwanted noise outside the maximal frequency band of interest, which is normally between about 4 and about 9 kHz. The filters 2001, 2002, 2003, 2004, are each followed by a respective selectable gain pre-amplifier 2005, 2006, 2007, 2008, the gain of which is selectable in 3-Db steps ranging from 0 dB to about 15 dB (hereinafter to be described more fully later). Four respective analog-to-digital converters 2009, 2010, 2011, 2012, follow the pre-amplifiers 2005, 2006, 2007, 2008. Respective digital finite impulse response (FIR) filters 2013, 2014, 2015, 2016, follow the A/D convertors 2009, 2010, 2011, 2012. The FIR filters 2013, 2014, 1015, 2016 determine the actual frequency band of operation, which is selected from the following four bands:

Band 1: about 4 to about 6 Khz;

Band 2: about 5 to about 7 Khz;

Band 3: about 6 to about 8 Khz; and

Band 4: about 7 to about 9 Khz.

One value for the gain of all of the pre-amplifiers 2005, 2006, 2007, 2008 will normally be selected for the four above bands as follows:

| Band 1 | Band 2 | Band 3 | Band 4 |
|---|---|---|---|
| 9 dB | 11 dB | 13 dB | 15 dB |
| 6 dB | 8 dB | 10 dB | 12 dB |
| 3 dB | 5 dB | 7 dB | 9 dB |
| 0 dB | 2 dB | 4 dB | 6 dB |

The selection of the frequency band would normally depend on the general nature of the expected vehicle traffic at the particular location of the above-road sensor arrays. The selected gain would depend, in addition, on the distance of the above-road sensor arrays from the road surface. The outputs of the FIR filters 2013, 2014 (the paths of $V_1$ and $V_2$) are summed in digital summer 2017, while the outputs of FIR filters 2015 and 2016 (the paths of $H_1$ and $H_2$) are summed in digital summers 2017 and 2018. The respective digital summers 2017 and 2018 are followed by digital limiters 2019 and 2020, respectively, and the outputs of the latter are input to correlator 2021, the output of which is fed to a parallel-to-serial convertor 2022, the serial output of which would normally be fed to a TDMA multiplexer (TMDA-MUX) 2023 to be time-division multiplexed with other (conveniently four) processed microphone array signals originating from overhead locations near the array 2000. The multiplexed output of the TMDA-MUX 2023 is then normally relayed by cable 2024 to roadside microprocessor-based controller 2025, where it is demultiplexed in DEMUX 2026 into the original number of serial outputs representing the serial outputs of correlators, e.g., 2021. After demultiplexing in DEMUX 2026, the cross-correlated digital output from the correlator 2021 is integrated in integrator 2027 (which could be a software routine in the microprocessor/controller 2025), and, depending on the correlated/integrated signal level, which is compared to a threshold in vehicle detector 2028, a "vehicle present" signal is issued for the duration above threshold. This information is processed by a flow parameter calculation routine 2029 of the controller 2025, the output of which is an RS232 standard in addition to hard-wired vehicle presence circuits or relays (not shown).

(I) Operation of Controller (i) Description of FIG. 21

The operation of the controller 2025, whereby the demultiplexed signal from DEMUX 2026 is processed, will be better explained by reference to the flow-chart shown in FIG. 21. The signal is adjusted in gain/offset 2100 depending on user-specific parameters 2101 and then sampled at 2102 and integrated at 2103. The signal sampling 2103 continues until enough samples at 2104 have been collected, upon which the integrator 2103 is reset at 2105 and the mode is determined at 2106. If the mode is initially to indicate vehicle presence, and a vehicle is detected at 2107, which by sound analysis as hereinbefore described, classifies the vehicle as a truck, the decision is immediately outputted at 2107. If the mode 2106 is "free flow", then long term speed average is calculated at 2109 from which variable thresholds are progressively calculated at 2110. That is, the more vehicles there are, the more accurate will the average progressively become. This variable threshold is used to continue to determine vehicle presence at 2111, and to calculate flow parameters 2112. For example, from the average speed and the time the vehicle is in the detection zone, the length of the vehicle is determined, and the truck classification is confirmed. This progressively yields a better determination of the speed of the particular vehicle, given the length of the detection zone. The latter, of course, depends on the frequency band and the distance of the microphone array 2000 from the road surface. On average, in many applications, the length of the detection zone 1707 would be about six feet. The flow parameters 2112 are stored in memory 2113 and outputted at 2114 over the RS232 serial link to (other) central traffic management systems (not shown), and where desired activate other interface circuits. As may be seen, the "free flow" processing is iterative in nature, while the binary vehicle presence decision 2106 is determined by a user selected fixed threshold 2108.

CONCLUSION

From the foregoing description, one skilled in the art can easily ascertain the essential characteristics of this invention, and without departing from the spirit and scope thereof, can make various changes and modifications the invention to adapt it to various usages and conditions. Consequently, such changes and modifications are properly, equitably, and "intended' to be, within the full range of equivalence of the following claims.

What is claimed is:

1. A traffic monitoring and warning system for a vehicle approaching a hazard, comprising:

(i) a first set of above-road electro-acoustic sensor arrays disposed adjacent a traffic lane in a first detection zone approaching a hazard for sensing a vehicle in said first detection zone and for producing signals indicative of said sensed vehicle;

(ii) a second set of above-road electro-acoustic sensor arrays, in a second detection zone downstream of said first set of above-road electro-acoustic sensor arrays for sensing a vehicle in said second detection zone and for producing signals indicative of said sensed vehicle in said second detection zone;

(iii) a processor operatively connected both to said first set of above-road electro-acoustic sensor arrays, and to said second set of above-road electro-acoustic sensor arrays, said processor for analysing said signals from said first set of electro-acoustic sensor arrays indicative of said sensed vehicle in said first detection zone to determine if said sensed vehicle is a truck, to determine a truck classification of said truck, and to determine an appropriate safe speed for traversing said hazard in view of hazard site-specific information and said classification, said processor also for analysing signals from said second set of above-road electro-acoustic sensors for determining the speed of said truck in said second detection zone, and (iv) a traffic signalling device associated with said traffic lane and disposed downstream of said first set of above-road electro-acoustic sensor arrays, said traffic signalling device being controlled by said processor to provide a warning to said truck concerning said appropriate safe speed, said second set of above-road electro-acoustic sensor arrays being upstream of said traffic signal, said processor also determining the actual speed of said truck in said first detection zone and activating said traffic signalling device if said actual speed exceeds said appropriate safe speed, said processor including a timer for discontinuing operating said traffic signalling device, said processor activating said timer in response to deceleration of said truck, said processor alternatively for discontinuing the operation of said traffic-signalling device if the speed of said truck in the second detection zone no longer exceeds said appropriate safe speed for said truck.

2. The system as claimed in claim 1, wherein said first set of above-road electro-acoustic sensor arrays is positioned to produce signals which are indicative of the configuration of said truck.

3. The system as claimed in claim 1, further comprising a weigh-in-motion scale operatively connected to the processor.

4. The system as claimed in claim 1, wherein said first set of above-road electro-acoustic sensors is adjacent said processor, wherein said processor determines the actual speed of said truck and a maximum safe speed for said truck and transmits a pre-emption signal to a traffic signal controller, causing said traffic signal controller to switch, or to maintain, said traffic signal to afford right of way through said intersection to said truck in the event that said actual speed of said truck exceeds said maximum safe speed for said truck to stop at said traffic-signal-controlled intersection, and for restoring control of said traffic signals to said traffic signal controller when said truck passes said traffic-light-controlled intersection.

5. The system as claimed in claim 1 wherein said hazard is a downgrade, wherein said traffic signalling device is at least one of a traffic sign and a message board, wherein said processor determines the actual speed of said truck and a maximum safe speed for said truck based on hazard site-specific information programmed into said processor, and wherein said processor transmits a pre-emption signal or a message signal to said traffic signalling device in the event that said actual speed of the truck exceeds said maximum safe speed.

6. The system as claimed in claim 1, wherein said hazard is a blind intersection or a curve.

7. The system as claimed in claim 1, further comprising a camera device for capturing at least one image of said truck upon said processor providing a warning to said truck.

8. The system as claimed in claim 7, further comprising a vehicle presence detector downstream of said camera device for generating a further signal when traversed by said truck, for deactivating said camera device.

9. The system as claimed in claim 1, wherein said first set of above-road electro-acoustic sensor arrays, and said second set of above-road electro-acoustic sensor arrays comprises:

(a) a first above-road electro-acoustic sensor array for receiving a first acoustic signal from said truck at a predetermined zone and for converting said first acoustic signal into a first electric signal that represents said first acoustic signal;

(b) a second above-road electro-acoustic sensor array for receiving a second acoustic signal which is radiated from said truck at said predetermined zone and for converting said second acoustic signal into a second electric signal that represents said second acoustic signal;

(c) spatial discrimination circuitry for creating a third electric signal based on said first electric signal and said second electric signal, that substantially represents acoustic energy emanating from said predetermined zone;

(d) frequency discrimination circuitry for creating a fourth signal which is based on said third signal; and (e) interface circuitry for creating an output signal based on said fourth signal such that said output signal is asserted when said truck is within said predetermined zone and whereby said output signal is retracted when said truck is not within said predetermined zone.

10. The system as claimed in claim 9 wherein said frequency discrimination circuitry comprises a bandpass filter.

11. The system as in claim 10, wherein said bandpass filter comprises a lower passband edge substantially close to about 4 KHz and an upper passband edge substantially close to about 6 KHz.

12. The system as claimed in claim 1, wherein said first set of above-road, electro-acoustic sensor arrays and said second set of above-road acoustic-electric sensor arrays comprises:

(A) a plurality of above-road electro-acoustic sensor arrays each trained on said detection zones;

(B) a bandpass filter for processing electrical signals from said plurality of above-road electro-acoustic sensor arrays;

(C) a correlator having at least two inputs and an output for correlating filtered versions of said electrical signals originating from at least two of said plurality of above-road electro-acoustic sensor arrays;

(D) an integrator for integrating said output of said correlator means over time; and (E) a comparator for indicating detection of said truck when said integrated output exceeds a predetermined threshold.

13. The system as claimed in claim 12, further comprising a plurality of analog-to-digital convertors for converting said electrical signals to digital representations prior to said processing thereof.

14. The system as claimed in claim 13, wherein said integrator and said comparator are each microprocessor-based programs.

15. The system as claimed in claim 12, wherein each of said plurality of electro-acoustic sensor arrays comprises two vertical multiple-microphone elements and two horizontal multiple-microphone elements, and wherein said correlator means has one of said at least two inputs receiving a sum of said two multiple-microphone vertical elements, and said other of said at least two inputs receiving a sum of said two horizontal multiple-microphone elements.

16. The system as claimed in claim 1, wherein said traffic signalling device comprises a fiber optic sign.

17. A method of controlling a traffic signalling device associated with a hazard comprising the steps of:

(i) downloading, into a processor, a first set of records of a first speed of a truck derived from signals from a first set of electro-acoustic sensor arrays disposed in a first detection zone adjacent a traffic lane approaching, and upstream of, said hazard, said processor analysing said signals from said first set of electro-acoustic sensor arrays which are indicative of a vehicle sensed in said first detection zone to determine if said sensed vehicle is a truck, to determine a truck classification of said truck, and to determine an appropriate safe speed for traversing said hazard in view of hazard site specific information downloaded into said processor and said classification;

(ii) downloading, into said processor, a second set of records derived from signals from a second set of electro-acoustic sensor array in a second detection zone downstream of said first set of electro-aoustic sensor arrays, said processor analysing said signals for determining the actual speed of said truck in said second detection zone;

(iii) disposing a traffic signalling device downstream of said second set of electro-acoustic sensor arrays;

(iv) matching records, by said processor, of said appropriate safe speed of said truck from said first set of records and of said actual speed of said truck from said second set of records;

(v) comparing, by said processor, said actual speed of said truck and said appropriate safe speed for said truck;

(vi) automatically operating, by said processor, said traffic signalling device if said actual speed of said truck exceeds said appropriate safe speed of said truck, to display a warning that said actual speed of said truck exceeds said appropriate safe speed of said truck; and (vii) discontinuing, by said processor, operating said traffic signalling device if said actual speed of said truck no longer exceeds said appropriate safe speed for said truck, by operating, by said processor, a timer to discontinue operating said traffic signalling device in response to deceleration of said truck.

18. The method as claimed in claim 17 which comprises selecting, as said electro-acoustic sensor arrays, a plurality of above-road sensor arrays.

19. The method as claimed in claim 17 wherein said hazard is a curve, and including the steps of:

associating said traffic signalling device with said curve;

disposing said first set of electro-acoustic sensor arrays upstream of said curve;

disposing said second set of electro-acoustic sensor arrays downstream of said first set of electro-acoustic serge arrays and upstream of said curve;

computing an appropriate safe speed which is the threshold speed for said truck to prevent said truck from rolling over; and measuring said actual speed of said truck at the point of curvature of said curve.

20. The method as claimed in claim 17 wherein said hazard is an intersection, and including the steps of:

disposing said traffic signalling device at a traffic-signal controlled intersection;

computing, by said processor, from said first set of records and from said second set of records, an actual speed of said truck and a stopping distance to enable said truck to stop which is derived from stopping threshold data downloaded into said processor;

computing, by said processor, said actual speed of said truck at a premeasured distance upstream from said intersection;

determining, by said processor, whether said truck will be able to stop before it reaches said intersection; and sending, by said processor, from said determination, a signal to said traffic signalling device to enable said truck to cross said intersection, and to discontinue operating said traffic signalling device after said truck crosses said intersection.

21. The method as claimed in claim 17, including the step of downloading a set of records of the actual weight of the truck.

22. The method as claimed in claim 17, including the step of addressing a video system to record truck passage at said traffic signalling device.

* * * * *